US009057983B2

(12) United States Patent
Takahashi et al.

(10) Patent No.: US 9,057,983 B2
(45) Date of Patent: Jun. 16, 2015

(54) DEVELOPER CONTAINER, DEVELOPER REPLENISHING DEVICE, DEVELOPING DEVICE, AND IMAGE FORMING APPARATUS USING SAME

(71) Applicants: Masaki Takahashi, Kanagawa (JP); Kunihiro Ohyama, Tokyo (JP); Hideki Kimura, Kanagawa (JP)

(72) Inventors: Masaki Takahashi, Kanagawa (JP); Kunihiro Ohyama, Tokyo (JP); Hideki Kimura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/972,177

(22) Filed: Aug. 21, 2013

(65) Prior Publication Data

US 2014/0064794 A1 Mar. 6, 2014

(30) Foreign Application Priority Data

Aug. 31, 2012 (JP) ..... 2012-192572

(51) Int. Cl.
*G03G 15/08* (2006.01)

(52) U.S. Cl.
CPC ..... *G03G 15/0868* (2013.01); *G03G 15/0837* (2013.01); *G03G 15/0886* (2013.01); *G03G 2215/0665* (2013.01); *G03G 15/0863* (2013.01); *G03G 15/0872* (2013.01)

(58) Field of Classification Search
CPC ..... G03G 15/0837; G03G 15/0832; G03G 2215/0665; G03G 2215/0668
USPC ..... 399/262, 120
See application file for complete search history.

(56) References Cited

U.S. PATENT DOCUMENTS

| | | | | |
|---|---|---|---|---|
| 5,455,662 | A * | 10/1995 | Ichikawa et al. | 399/260 |
| 6,256,469 | B1 * | 7/2001 | Taniyama et al. | 399/258 |
| 2003/0156861 | A1 * | 8/2003 | Nagano et al. | 399/262 |
| 2007/0086809 | A1 * | 4/2007 | Yamane | 399/258 |
| 2007/0147900 | A1 | 6/2007 | Taguchi et al. | |
| 2010/0226690 | A1 | 9/2010 | Kadota et al. | |
| 2010/0329699 | A1 | 12/2010 | Ohyama et al. | |
| 2011/0058857 | A1 | 3/2011 | Hori et al. | |
| 2011/0176820 | A1 | 7/2011 | Kadota et al. | |
| 2011/0222871 | A1 | 9/2011 | Suzuki et al. | |
| 2011/0311281 | A1 | 12/2011 | Ohyama et al. | |
| 2012/0033998 | A1 | 2/2012 | Hori et al. | |
| 2012/0141169 | A1 | 6/2012 | Yamane et al. | |
| 2012/0163877 | A1 | 6/2012 | Kikuchi et al. | |
| 2012/0195645 | A1 | 8/2012 | Takami et al. | |
| 2012/0200871 | A1 | 8/2012 | Takahashi et al. | |
| 2012/0207492 | A1 | 8/2012 | Fujiwara et al. | |
| 2012/0219330 | A1 | 8/2012 | Kikuchi et al. | |
| 2012/0230735 | A1 | 9/2012 | Uchitani et al. | |
| 2012/0308242 | A1 | 12/2012 | Yamane et al. | |

(Continued)

FOREIGN PATENT DOCUMENTS

| | | |
|---|---|---|
| JP | 2007-65368 A | 3/2007 |
| JP | 2007-065613 | 3/2007 |

*Primary Examiner* — Rodney Bonnette
(74) *Attorney, Agent, or Firm* — Oblon, McClelland, Maier & Neustadt, L.L.P.

(57) ABSTRACT

A developer container removably installable in an apparatus body of an image forming apparatus includes a container body to contain developer, a cap connectable to the container body, the cap including a supply opening, and a flange projecting beyond an outer circumferential surface of the cap in a radial direction extending from a center of a cross section of the container body. The flange is formed along a circumference of the container body and provided between the container body and the cap.

10 Claims, 27 Drawing Sheets

(56) References Cited‘

U.S. PATENT DOCUMENTS

2012/0321341 A1 12/2012 Hori et al.
2013/0045029 A1 2/2013 Kimura et al.
2013/0051841 A1 2/2013 Ohyama et al.
2013/0064570 A1 3/2013 Yamane et al.

* cited by examiner

DEVELOPER CONTAINER, DEVELOPER REPLENISHING DEVICE, DEVELOPING DEVICE, AND IMAGE FORMING APPARATUS USING SAME

CROSS-REFERENCE TO RELATED APPLICATION

This patent application is based on and claims priority pursuant to 35 U.S.C. §119 to Japanese Patent Application No. 2012-192572, filed on Aug. 31, 2012, in the Japan Patent Office, the entire disclosure of which is hereby incorporated by reference herein.

BACKGROUND OF THE INVENTION

1. Technical Field

The present invention generally relates to a developer container, a developer replenishing device, a developing device, and an image forming apparatus, such as, a copier, a printer, a facsimile machine, a plotter, or a multifunction peripheral (MFP) including at least two of coping, printing, facsimile transmission, plotting, and scanning capabilities, and further relates to prevention of erroneous installation of a developer container.

2. Description of the Background Art

Image forming apparatuses such as copiers, printers, and facsimile machines, form latent images on an image bearer, develop the latent images by a developing device, and then transfer the developed image onto sheets of recording media. To maintain a desired image density, developer is supplied to the developing device by developer replenishing devices such as toner replenishing devices. For example, when the concentration of toner in developer supplied to the photoreceptor decreases, a toner replenishing device supplies toner contained in a toner container, which is generally called a toner bottle or toner cartridge, to the developing device. In the description below, toner replenishing devices may represent developer replenishing devices and toner containers may represent developer containers as a matter of convenience.

Typically, developer containers are removably mountable in a mount provided in developer replenishing devices and replaced when no toner remains therein or color is to be changed.

There are developer containers that include a container body, a cap provided to an opening at one end of the container body, and a spiral groove formed in the outer circumference of the container body. Such a configuration is proposed, for example, in JP-2007-065613-A. In this configuration, as the container body and the spiral groove thereof rotate, developer or toner contained in the container body moves toward a supply opening (i.e., toner outlet) formed in the cap.

The developer container is inserted into the developer replenishing device from an insertion opening formed therein and positioned in the developer replenishing device such that the supply opening faces a receiving part of the developer replenishing device so that developer can be supplied from the container body thereto.

To increase the capacity, cylindrical container bodies that are long in the axial direction thereof may be used in developer containers. In such a configuration, the developer container filled with developer tends to be heavy, and it is not easy for users or operators to insert the heavy developer container into the insertion opening while holding the developer container, in particular, keeping an orientation proper for installation.

The term "orientation proper for installation" used here means that the developer container is oriented in the axial direction of the developer container being inserted properly and that the supply opening formed in the cap can face and closely contact a receiving inlet of the developer replenishing device.

When the developer container inserted is oblique to the axial direction of the developer container being inserted properly, clearance can be present between the supply opening formed in the cap and the receiving part of the developer replenishing device, allowing developer to leak through the clearance.

Relating to this inconvenience, the above-described JP-2007-065613-A proposes forming a guiding portion to guide the toner container to slide in a toner-container holder formed in a toner replenishing device. The guiding portion can be a guide face (or sliding face) on which the bottom face of the toner container slides. Alternatively, the toner-container holder includes guiding portions into which sliding pieces provided on both sides of the toner container in a horizontal direction are fitted such that the guiding portions guide the toner container.

In this configuration, the toner container being inserted can be prevented from inclining relative to the axial direction as the bottom face of the toner container slides on the guide face of the toner-container holder, or the sliding pieces slide in the guiding portions of the toner-container holder.

SUMMARY OF THE INVENTION

In view of the foregoing, one embodiment of the present invention provides a developer container removably installable in an apparatus body of an image forming apparatus. The developer container includes a container body to contain developer, a cap connectable to the container body, and a flange projecting beyond an outer circumferential surface of the cap in a radial direction extending from a center of a cross section of the container body. The flange is formed along a circumference of the container body and provided between the container body and the cap. In the cap, a supply opening is formed.

Another embodiment provides a developer replenishing device that includes a receiving inlet and a developer tank. The receiving inlet communicates with the supply opening of the above-described developer container to receive developer therefrom, and the received developer is stored in the developer tank.

Yet another embodiment provides a developing device that includes a developer bearer to carry by rotation developer, and a developer containing compartment to which developer is supplied by the above-described developer replenishing device.

Yet another embodiment provides an image forming apparatus that includes an image bearer on which a latent image is formed, and the above-described developing device.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
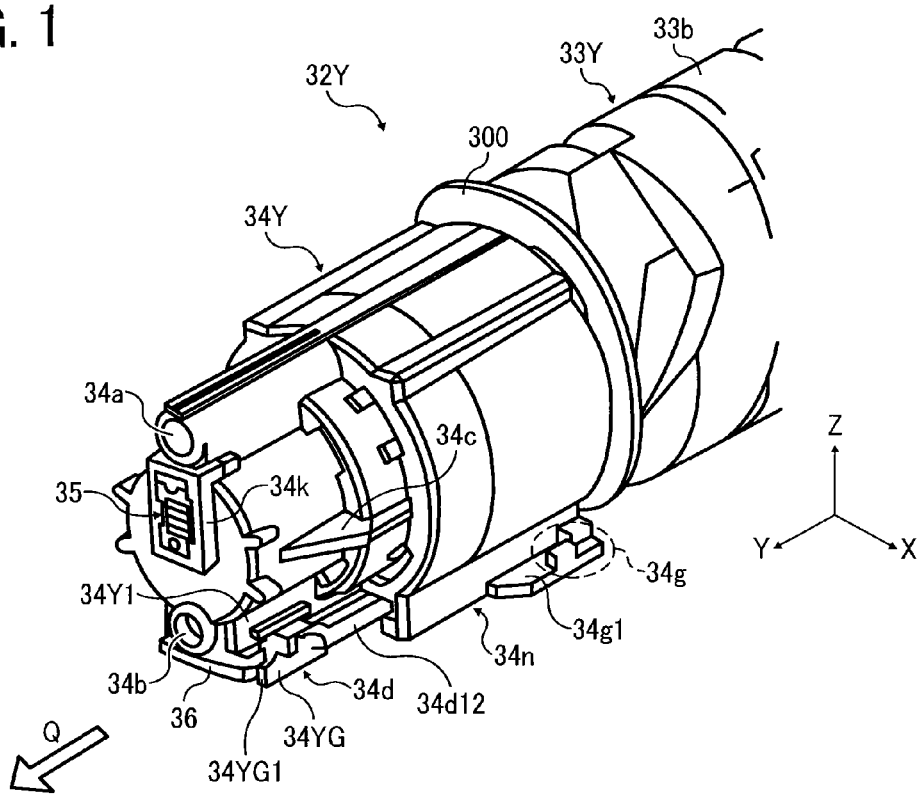
FIG. 1 is a perspective view of a configuration of a developer container according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary. Further, the term "cylindrical" used in this specification is not limited to round columns but also includes polygonal prisms.)

It is to be noted that distinctive features of the present embodiment relate to a developer container described with reference to FIGS. 1 to 3. Additionally, features of the present embodiment can adapt to a variation of the developer container shown in FIG. 18 and subsequent drawings.

FIG. 1 is a perspective view of a configuration of a developer container 32Y according to the present embodiment.

In the configuration shown in FIG. 1, the developer container 32Y is, for example, a substantially cylindrical toner bottle, and a spiral rib 33*b* leading to a toner outlet W is formed on the outer circumferential face thereof. The developer container 32Y includes a cap 34Y and a container body (bottle body) 33Y formed integrally with a gear 33*c* (shown in FIG. 9). The spiral rib 33*b* is formed in the container body 33Y. The cap 34Y is held by a container mount 70 (shown in FIGS. 4 and 7) not to rotate, and the container body 33Y is held rotatably relative to the cap 34Y.

As the container body 33Y is rotated, toner contained in the container body 33Y is transported in the longitudinal direction of the developer container 32Y to the toner outlet W serving as a supply opening and discharged from the toner outlet W.

The cap 34Y of the developer container 32Y is provided with a shutter 34*d*, an identification (ID) chip 35 serving as a data storage device, a shutter seal 36 of the shutter 34*d*, and the like.

Figure 7:
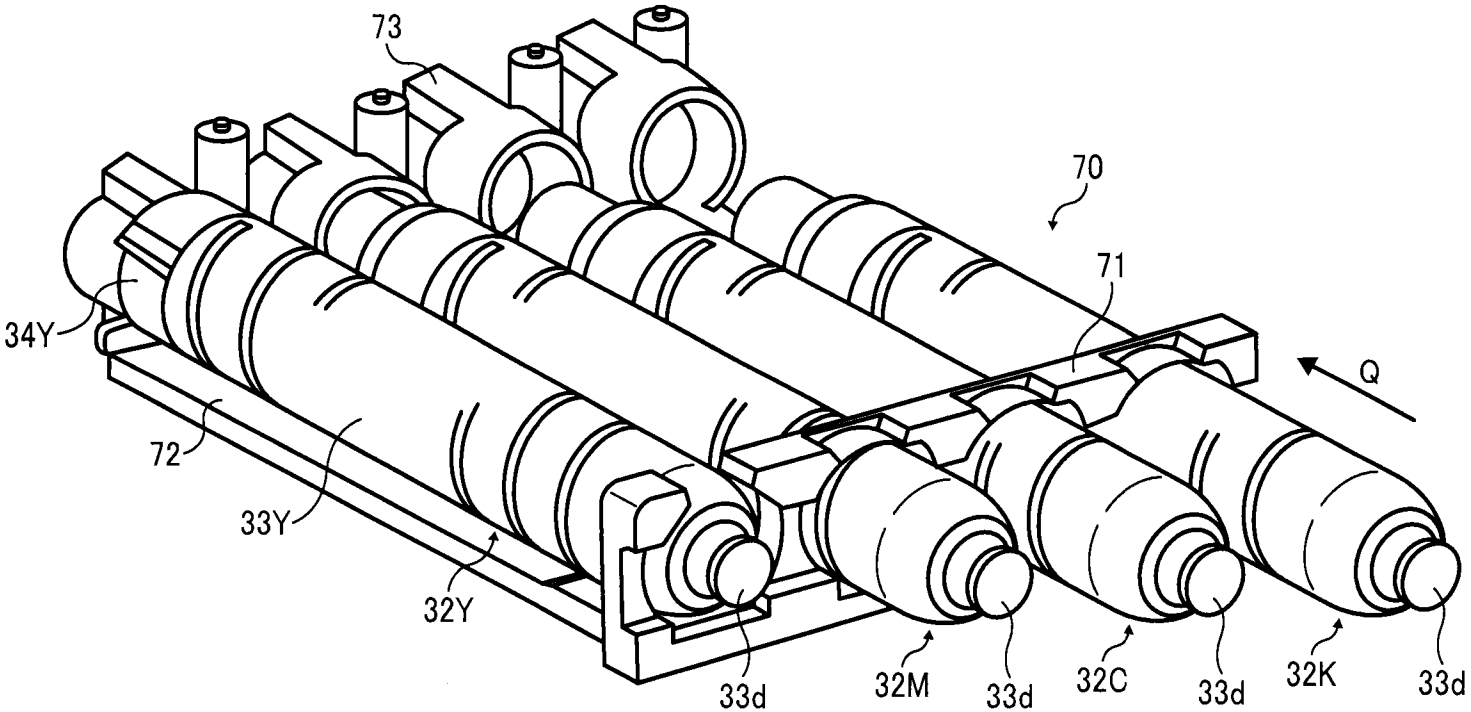
FIG. 7 is a perspective view of a container mount included in the image forming apparatus shown in FIG. 4, in which four developer containers are mounted.

In an end face an a head side (on the left in FIG. 1) of the cap 34Y, first and second positioning holes 34*a* and 34*b* are respectively formed at positions different in a vertical direction to engage first and second positioning pins provided to a cap holder 73 (shown in FIG. 7).

Between the first and second positioning holes 34*a* and 34*b*, a quadrate recess 35*a* (shown in FIG. 9) extending vertically is formed. The recess 35*a* is shaped to connect to a connector provided to the container mount 70 (shown in FIG. 7). A chip setting 34*k* in which the ID chip 35 is mounted is attached to the recess 35*a*.

Roughly speaking, the cap 34Y shown in FIG. 1 is constructed of a cylindrical member and box portions 34*n* and 34Y1 on the bottom of the cylindrical member. The external diameter and internal diameter of the cylindrical member decrease stepwise from the side of the container body 33Y to the side of the shutter 34*d* and includes large, moderate, and small cylindrical portions. The box portions 34*n* and 34Y1 are different in horizontal width (hereinafter also "wide and narrow box portions 34*n* and 34Y1"). The wide box portion 34*n* has a width WD1, and the narrow box portion 34Y1 has a width WD2 as shown in FIG. 10.

The large and moderate cylindrical portions and the wide box portion 34*n* together form an inner insertion portion of the cap 34Y.

Figure 10:
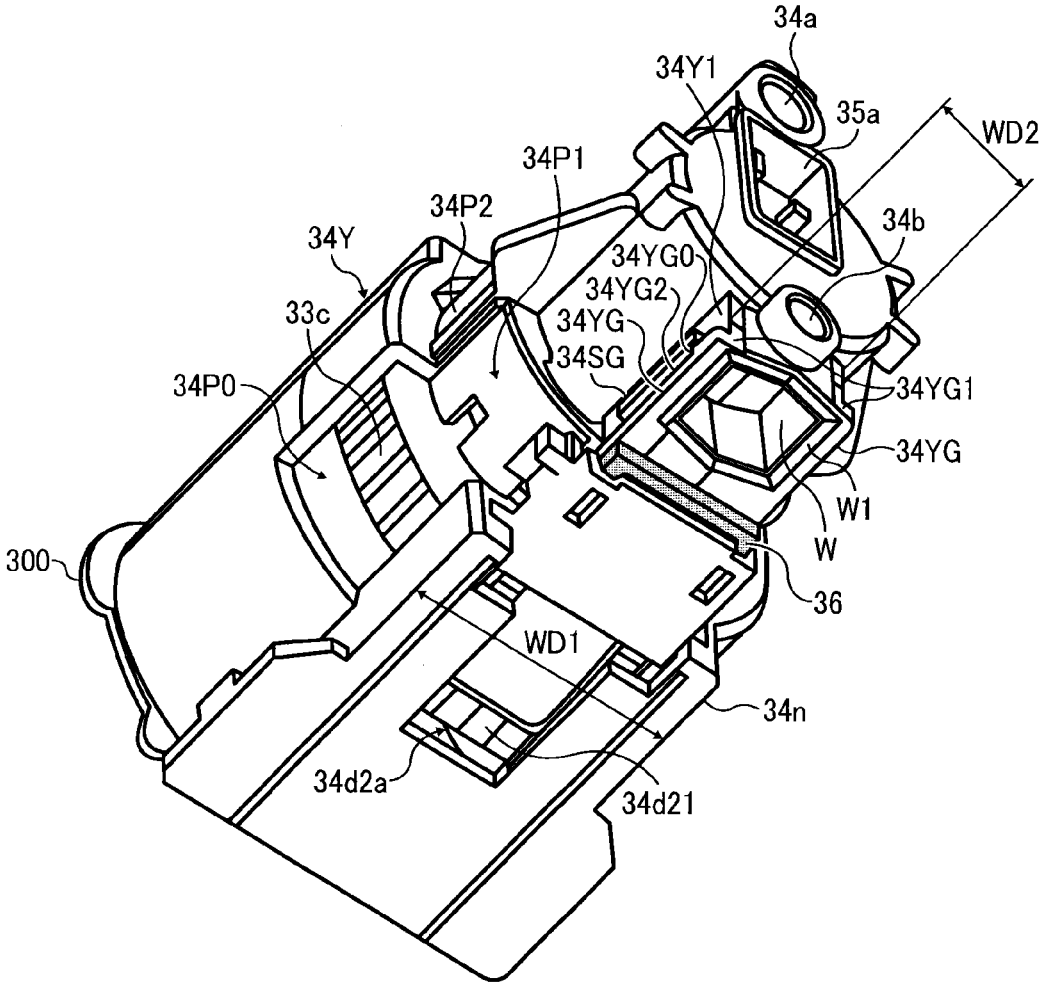
FIG. 10 is a perspective view of the cap shown in FIG. 1 as viewed from the bottom of a shutter thereof.

The outer circumference of the large cylindrical portion of the cap 34Y is cut away partly, forming a cutout 34P0 shown in FIG. 10, so that a part of the teeth of the gear 33*c* is exposed.

In FIG. 1, lateral projections 34*c* are formed on the outer circumferential face of the moderate cylindrical portion. The lateral projections 34*c* are triangular on plan views respectively positioned on both sides in a direction on the same plane as the vertical arrangement direction of the first and second positioning holes 34*a* and 34*b* and perpendicular to that vertical arrangement direction. An apex thereof is positioned such that the outer end in the lateral direction moves away from the outer circumferential face of the moderate cylindrical portion from the head side of the cap 34Y toward the opposite end (i.e., a second end).

A projection 34*g* disposed at the wide box portion 34*n* enables identification of each developer container, in particular, that is, compatibility. The projection 34*g* is provided on a sliding piece 34*g*1 laterally projecting from the cap 34Y, and the position of the projection 34*g* varies among respective colors. The sliding piece 34*g*1 fits in a guiding portion 301 (shown in FIG. 3) formed in the container mount 70 of the developer replenishing device to guide sliding of the developer container 32Y.

Figure 6:
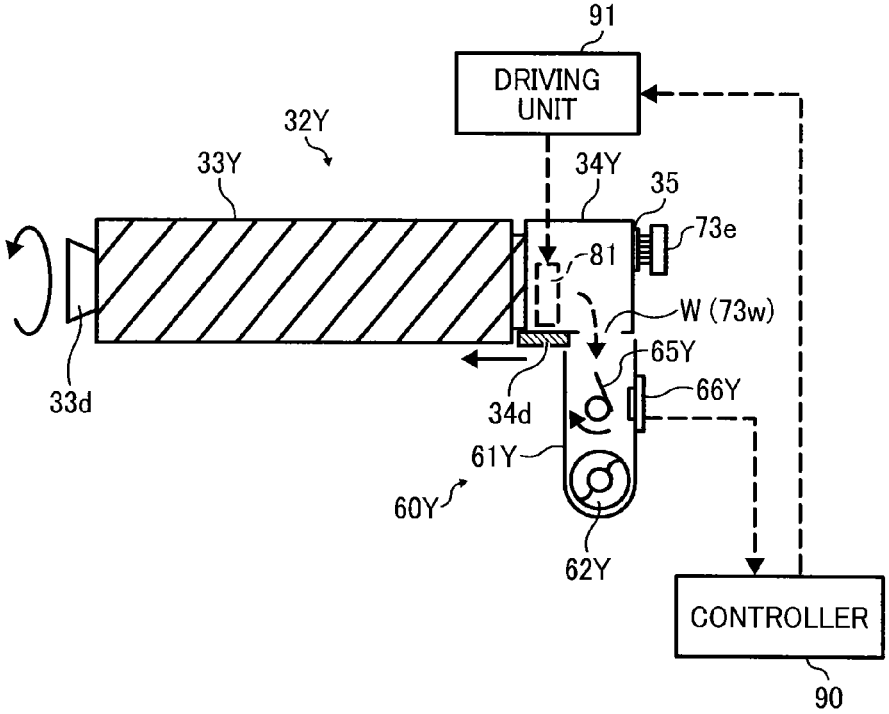
FIG. 6 is a schematic diagram illustrating the developer container mounted in the developer replenishing device according to an embodiment.

In FIG. 1, the shutter 34*d* opens and closes the toner outlet W shown in FIG. 6, and the shutter seal 36 is provided to a side of the shutter 34*d* facing the toner outlet W.

The configuration shown in FIG. 1 further includes a guide rail 34YG on which the shutter 34*d* slides and a contact face 34YG1 to abut against a pivotable clamp portion of a shutter retainers 73*d* (shown in FIG. 14), thereby causing the clamping portion to pivot. The clamping portion is positioned adjacent to the guide rail 34YG and clamps the shutter 34*d* from both sides.

In insertion of the developer containers 32, the developer container 32 may lean toward a side (i.e., one-sided) inside the insertion opening from the following reason, thus inhibiting proper installation of the developer container 32.

The external diameter of developer containers often varies depending on the consumption of toner contained therein. For example, the developer container for containing black toner, which is typically consumed more than other color toners, can be made greater in external diameter than developer containers for other color toners. In such cases, the insertion opening formed in the developer replenishing device is often sized for the developer container for the most consumed color toner, that is, the developer container largest in external diameter.

In addition, the container body is typically larger in diameter than the cap provided to the opening at one end of the container body. Accordingly, the insertion opening formed in the developer replenishing device is larger than the cap. Therefore, in the case of the developer container for toner that is used less than black toner, the clearance between the inner face enclosing the insertion opening and the cap is greater than the clearance between the inner face enclosing the insertion opening and the cap of the developer container for black toner.

When the diameter of the cap and that of the insertion opening are different in dimension, the developer container is likely to deviate within the difference in dimension and lean toward a given part inside the insertion opening. In particular, in insertion of developer containers having container bodies smaller in external diameter than the largest external diameter, the possibility of leaning is higher since the difference in dimension is greater.

If the developer container 32 leans to one side during insertion, the relative positions of the guiding portions 301 provided to the insertion opening A1 sized for the largest developer container (for example, the developer container 32K for black) and the sliding pieces 34*g*1 of the developer container are disturbed. In this state, while one of the sliding pieces 34*g*1 on both sides of the cap 34 fits in the guiding portion 301, the other sliding piece 34*g*1 is not fitted in the guiding portion 301 due to the above-described difference in dimension but, for example, steps on the upper face of the guiding portion 301.

This situation can also arise when the operator or user fails to check the insertion state during the insertion of the developer container 32.

Figure 27:
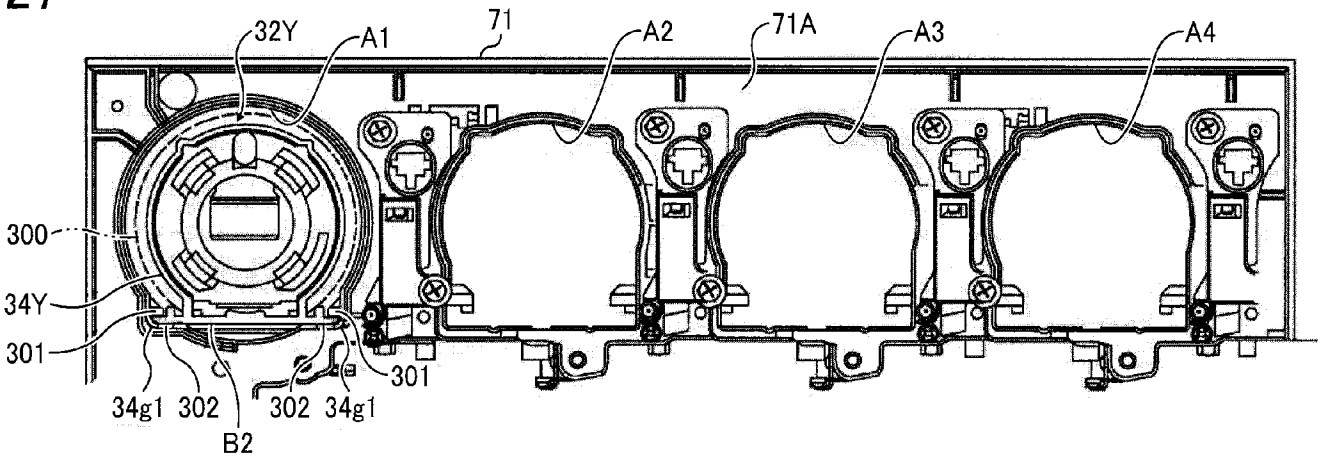
FIG. 27 illustrates a state in which the position of the developer container being installed is proper.
Figure 28:
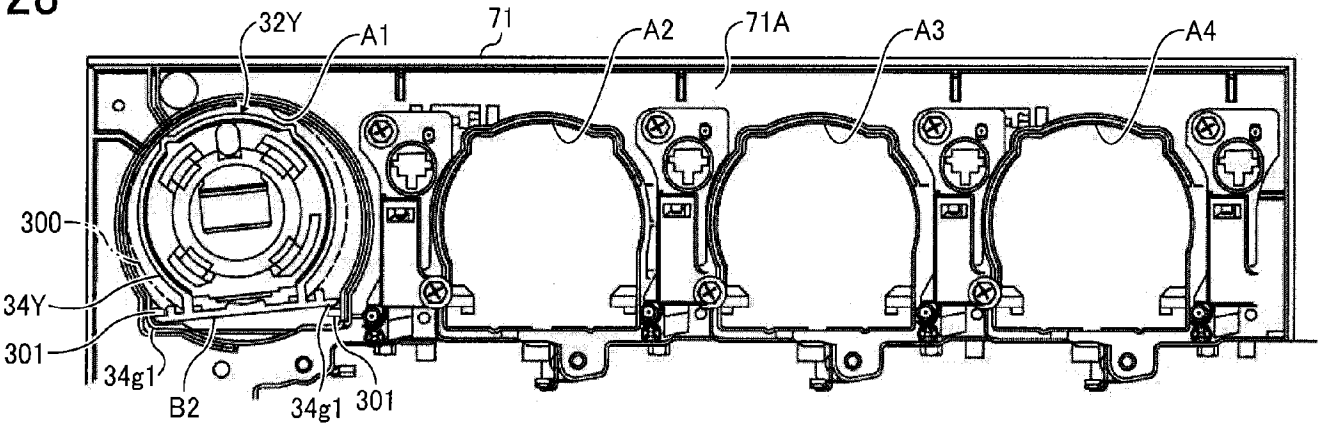
FIG. 28 illustrates a state in which the position of the developer container being installed is not proper.

Referring to FIGS. 27 and 28, insertion of the developer container 32Y having the container body 33Y smaller in external diameter than that of the largest container body (for example, the container body 33K for containing black toner) is described below. FIG. 27 illustrates a state in which the developer container 32Y is inserted properly into the developer replenishing device, and FIG. 28 illustrates a state in which insertion of the developer container 32Y is not proper.

Figure 4:
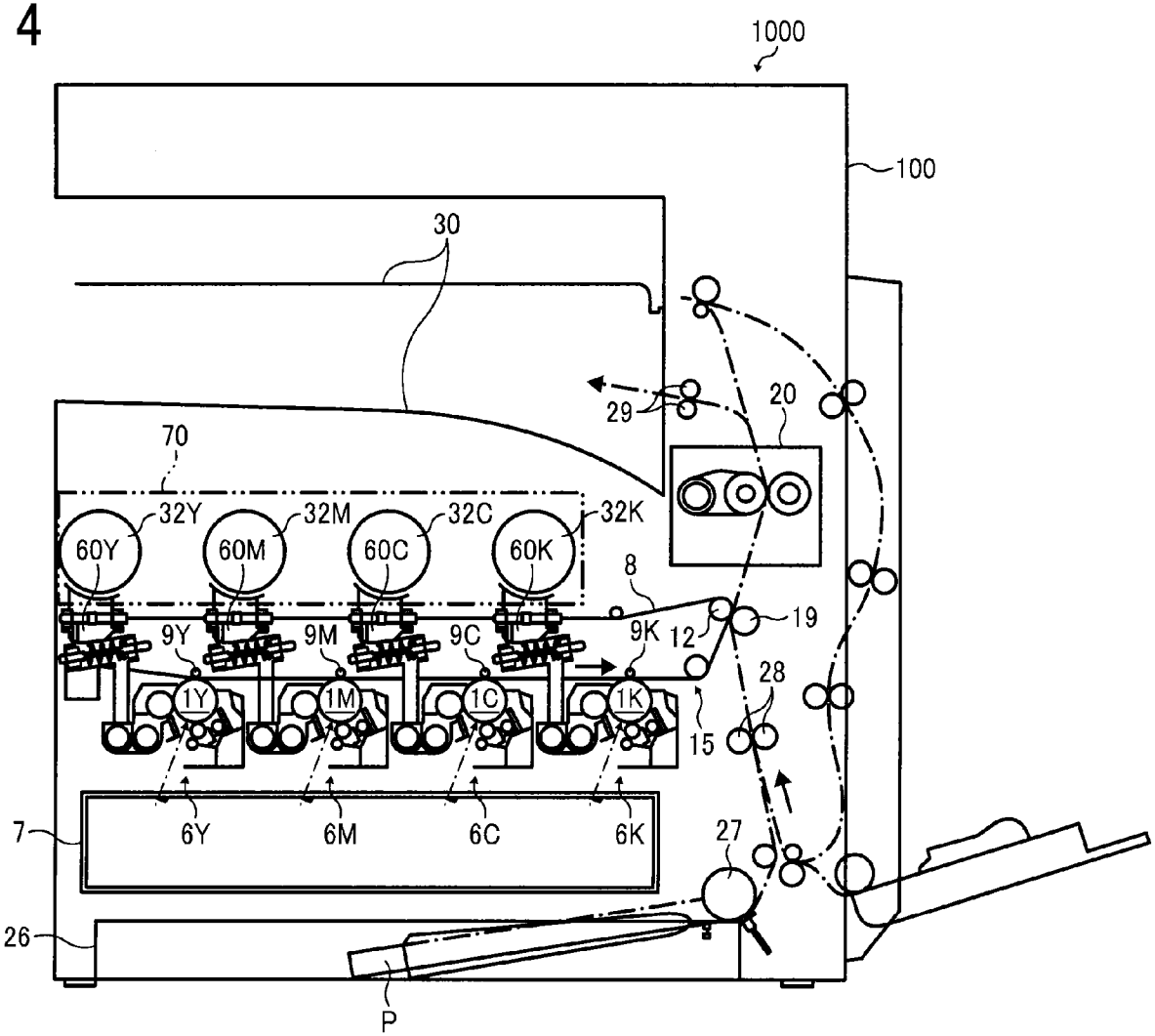
FIG. 4 is a schematic diagram that illustrates a configuration of an image forming apparatus incorporating a developer replenishing device according to an embodiment.

In FIGS. 27 and 28, multiple insertion openings A1, A2, A3, and A4 are formed in a wall 71A (i.e., an insertion section) of an insertion section 71 (shown in FIG. 7) of a developer replenishing device 60 (shown in FIGS. 4 and 6).

The developer containers 32 are inserted into the insertion openings A1 to A4, respectively. The sliding pieces 34*g*1 project laterally from a bottom face B2 of the cap 34Y. The container mount 70 is formed on the back side of the wall 71A, and the sliding pieces 34*g*1 can fit in guiding portions 301 provided to the container mount 70. The guiding portions 301 extend in the direction perpendicular the surface of the paper on which FIGS. 27 and 28 are drawn. In insertion of the developer container 32Y, a proper posture of the developer container 32Y along the direction in which the guiding portions 301 extend can be maintained by the sliding pieces 34*g*1 fitted in the guiding portions 301.

In FIG. 27, both of the sliding pieces 34*g*1 of the developer container 32Y are fitted in the guiding portions 301. In this state, the cap 34Y of the developer container 32Y does not lean to a side of the insertion opening A1. Accordingly, the toner outlet W (supply opening) can face and closely contact a supply inlet 73*w* (shown in FIG. 6, serving as a receiving inlet) formed in the container mount 70, thus inhibiting leak of toner and improper relative positions between the container body and a driving unit 91 (shown in FIG. 6) therefor.

In FIG. 28, the cap 34Y of the developer container 32Y leans to one side of the insertion opening A1, and one of the sliding pieces 34*g*1 is not fitted in but steps on the guiding portions 301. If the leaning developer container 32Y is inserted further into the container mount with the sliding piece 34*g*1 disposed on the guiding portion 301, the supply opening (discharge outlet) in parallel to the bottom face B2 of the cap 34Y faces the supply inlet 73*w* formed in the developer replenishing device 60 in an inclined manner. Accordingly, clearance is present between the supply opening (discharge outlet) of the cap 34Y and the supply inlet 73*w*, and the risk of toner leak arises. Additionally, it is possible that the relative positions of the container body 33 and the driving unit 91 therefore are disturbed, and drive force is not transmitted.

In view of the foregoing, further a flange or collar 300 is positioned between the container body 33Y and the cap 34Y in the present embodiment. The flange 300 projects in a radial direction extending from a center of a cross section of the container body 33Y. For example, the "cross section" here means a cross section perpendicular to the insertion direction (indicated by arrow Q in FIG. 1) of the developer container 32Y.

Figure 2:
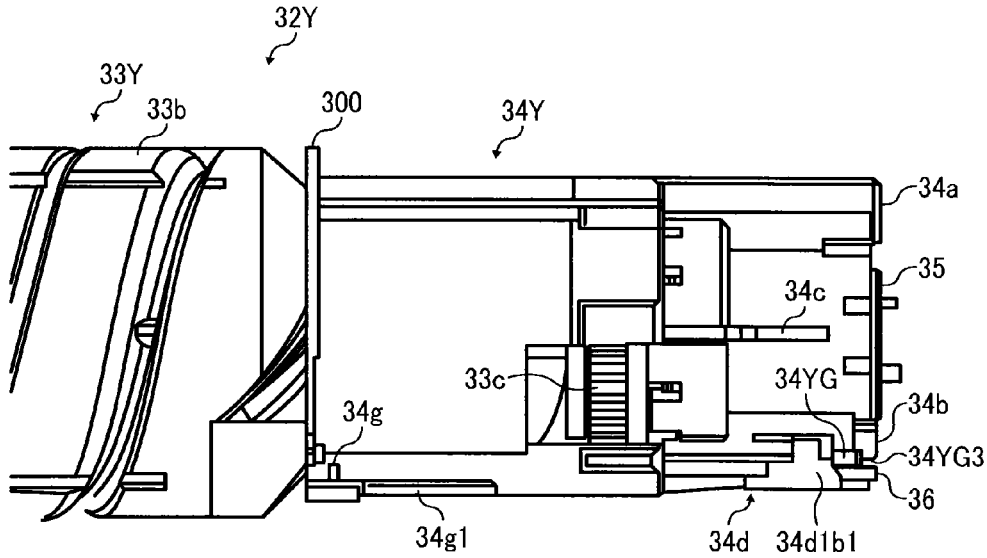
FIG. 2 illustrates a side face of the developer container shown in FIG. 2.

As shown in FIG. 2, the flange 300 is continuously formed over the entire circumference of an end face at the second end of the cap 34Y that faces the container body 33Y.

The flange 300 projects by an amount to make the external diameter of the flange 300 similar to or slightly smaller than the external diameter of the container body 33Y so that the developer container 32Y does not lean to a part of the inner face of the insertion opening A1 (in FIG. 27) formed in the wall 71A (in FIG. 27) and that the developer container 32Y does not interfere with the insertion opening during insertion. Therefore, with the projection amount, the developer container 32Y can contact the rim forming the insertion opening when the position of the developer container 32Y being inserted leans to one side (i.e., a leaning side) of the inner face enclosing the insertion opening A1.

Figure 3:
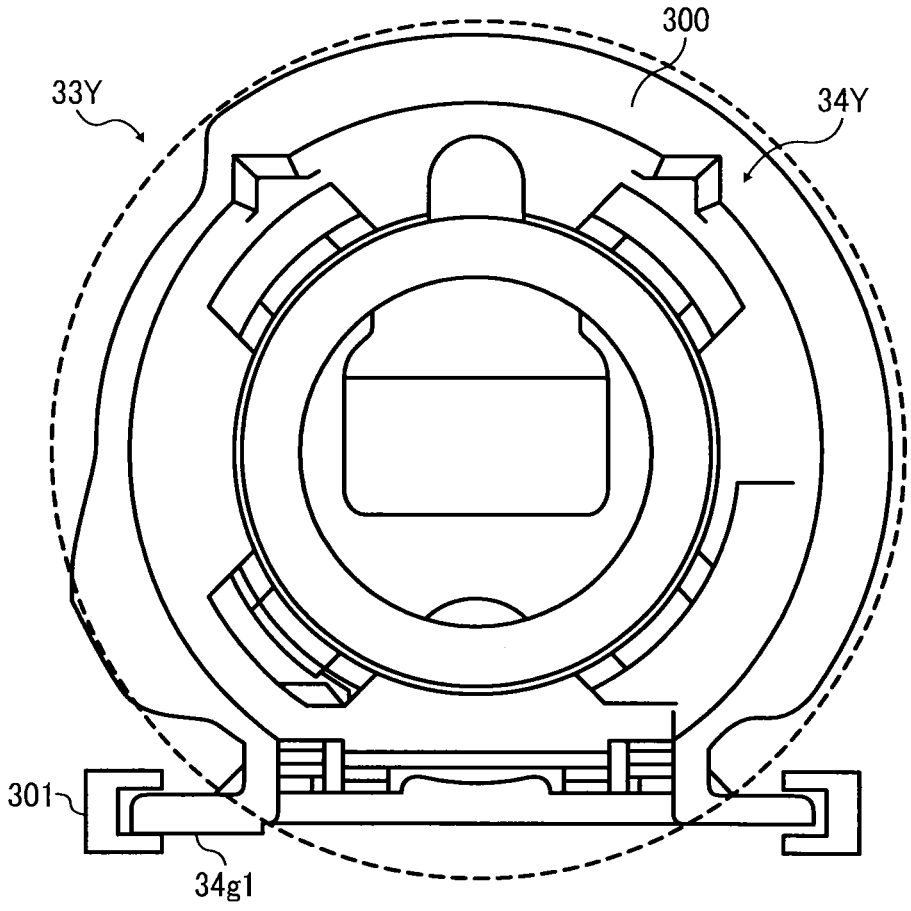
FIG. 3 illustrates the developer container shown in FIG. 1 from a side of a cap.

As shown in FIGS. 2 and 3, the flange 300 is greater in external diameter than the large cylindrical portion of the cap 34Y.

On the side of the cap 34Y facing the container body 33Y, the flange 300 is closer to the container body 33Y than the sliding piece 34*g*1. Depending on the position of the flange 300, alignment between the sliding piece 34*g*1 of the cap 34Y and the guiding portion 301 of the developer replenishing device can be checked when the cap 34Y is inserted into the insertion opening.

The above-described configuration enables determination of whether the developer container 32Y is deviating toward a part of the inner face enclosing the insertion opening and whether the cap 34Y is at an improper position when the developer container 32Y is inserted.

Specifically, when the developer container 32Y deviates toward a side in the insertion opening, it is possible that the sliding piece 34*g*1 of the cap 34Y is not fitted in but positioned above the guiding portion 301 provided adjacent to the insertion opening while the developer container 32Y is inserted.

At that time, it is possible that the sliding piece 34*g*1 at one side of the cap 34Y is disengaged from the guiding portion 301.

By contrast, as the developer container 32Y deviates to one side of the insertion opening A1, the corresponding portion of the flange 300 approaches to the inner face enclosing the insertion opening A1. If insertion of the developer container 32Y is continued, the flange 300 contacts the end face (i.e., rim) enclosing the insertion opening A1.

It is to be noted that, in FIG. 27, a part of the flange 300 of the developer container 32Y interferes with (abuts against) the rim of the insertion opening A1 on the leaning side.

With this configuration, whether or not the developer container 32Y is inserted properly can be determined. Consequently, the user or operator can be invited to draw out and reinsert the developer container 32Y so that the flange 300 does not contact the end face of the insertion opening, that is, both sliding pieces 34*g*1 of the cap 34Y can fit in the respective guiding portions 301 of the container mount 70. Additionally, it is desirable that, before the sliding piece 34*g*1 steps onto the guiding portion 301, the flange 300 contacts the end face of the insertion opening A1.

With the above-described aspect of the present embodiment, when the flange 300 contacts the end face of the insertion opening A1, it can be deemed that the developer container 32Y being inserted is deviating to one side of the insertion opening A1.

In other words, this configuration enables the operator to foresee the possibility that the toner outlet W, serving as the supply opening, formed in the cap 34Y does not closely contact the supply inlet 73*w* (receiving inlet) of the developer replenishing device 60, allowing toner to leak, or that the relative positions of the container body 33Y and the driving unit 91 therefor are not proper at the time of insertion of the developer container 32Y.

With this configuration, the operator can easily check the insertion state of the developer container 32Y even if the operator overlooks the relative positions of the guiding portion 301 adjacent to the insertion opening in the developer replenishing device 60 (or the container mount 70) and the sliding piece 34*g*1 on the bottom of the cap 34Y, which is a blind spot for the operator.

It is to be noted that, in addition to the configuration including the flange 300 to enable the operator to check the insertion state, the following configuration may be provided to facilitate engagement between the sliding piece 34*g*1 of the cap 34Y and the guiding portion 301 adjacent to the insertion opening formed in the developer replenishing device.

That is, a projecting piece 302 shown in FIG. 27 can be provided to the end face surrounding the insertion opening A1 on the upstream side in the insertion direction of the developer container 32Y. The projecting piece 302 projects to the upstream side (front side of the paper on which FIG. 27 is drawn) from the end face and parallels the bottom face (represented by reference character B2 in FIG. 27) of the cap 32Y.

This configuration can inhibit inclination of the cap 32Y (in FIG. 27) in the circumferential direction can be inhibited and accordingly facilitate the engagement between the sliding piece 34*g*1 (34*g*1 in FIG. 27) and the guiding portion 301.

Additionally, although the cap 34Y may deviate and cause one of the sliding pieces 34*g*1 to ascend onto the guiding portion 301, resulting in the inclination in the circumferential direction thereof, such inclination can be inhibited by the lateral projection 34*c* shown in FIGS. 1 and 2.

In the present embodiment, since the flange 300 is disposed between the container body 33Y and the cap 34Y, that is, upstream from the lateral projection 34*c* in the insertion direction of the developer container 32Y, the operator can foresee that the lateral projection 34*c* moves while stepping onto the engagement portion.

Next, descriptions are given below of the developing device, the developer replenishing device, and the image forming apparatus that use the developer container according to the present embodiment with reference to FIG. 4 and subsequent drawings. The developer container described below has a distinctive feature relating to the shutter to open and close the toner supply inlet formed in the cap 34Y. It is to be understood that an identical or similar reference character is given to identical or corresponding parts throughout the drawings, and redundant descriptions are omitted or simplified below.

Referring to FIGS. 4 through 8, configurations and operations of an image forming apparatus 1000 using the developer containers 32 and image forming units 6 thereof are described together with the configuration and operation of the container mount 70. The image forming units 6 incorporates developing devices 5, and the container mount 70 is used for the developing devices 5.

As shown in FIG. 4, the container mount 70 is provided in an upper part of an apparatus body 100 of the image forming apparatus 1000, and four developer containers 32Y, 32M, 32C, and 32K respectively corresponding to yellow, magenta, cyan, and black are removably installed in the container mount 70.

An intermediate transfer unit 15 including an intermediate transfer belt 8 is provided beneath the container mount 70.

The image forming units 6Y, 6M, 6C, and 6K respectively corresponding to yellow, magenta, cyan, and black are arranged in parallel, facing the intermediate transfer belt 8.

The developer replenishing devices 60Y, 60M, 60C, and 60K are provided beneath the replaceable developer containers 32Y, 32M, 32C, and 32K, respectively. Each developer replenishing device 60 supplies toner contained in the corresponding developer container 32 to the developing device 5 of the corresponding image forming unit 6.

Figure 5:
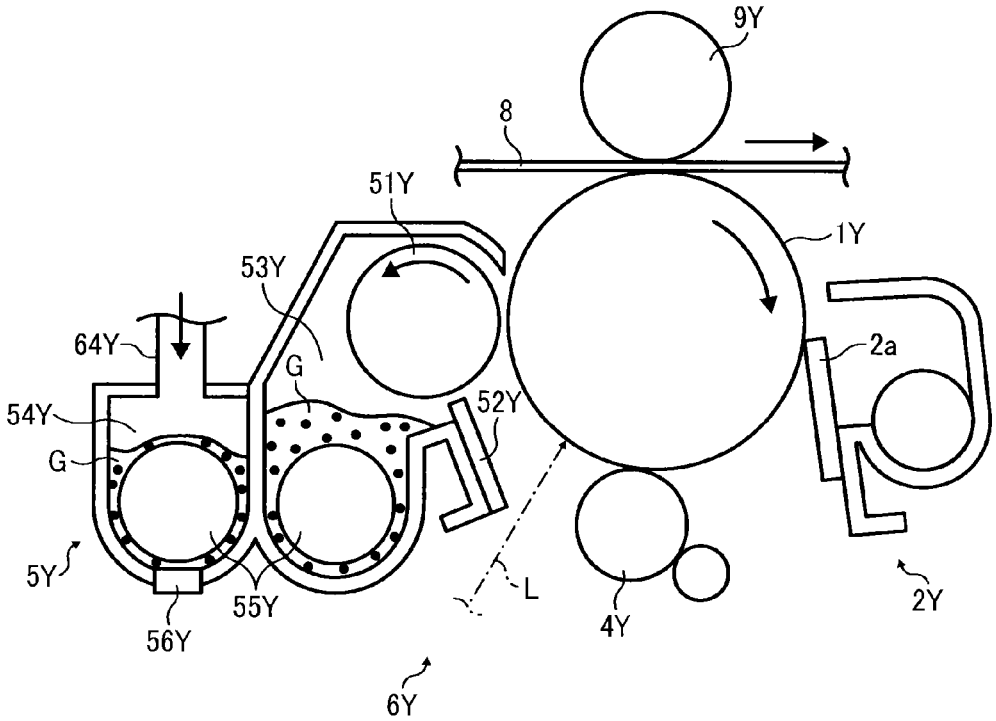
FIG. 5 is a schematic diagram that illustrates a configuration of a developing device usable in the image forming apparatus shown in FIG. 4.

FIG. 5 is a schematic diagram illustrating the image forming unit 6Y. Referring to FIG. 5, the image forming unit 6Y for yellow includes a photoreceptor drum 1Y and further includes a charging member 4Y, the developing device 5Y, a cleaning unit 2Y, a discharger, and the like provided around the photoreceptor drum 1Y. Image forming processes, namely, charging, exposure, development, transfer, and cleaning processes are performed on the photoreceptor drum 1Y, and thus a yellow toner image is formed on the photoreceptor drum 1Y.

It is to be noted that other image forming units 6 have a similar configuration to that of the yellow image forming unit 6Y except the color of the toner used therein, and different color toner images are formed in the respective image forming units 6. Thus, only the image forming unit 6Y is described below and descriptions of other image forming units 6M, 6C, and 6K are omitted.

Referring to FIG. 5, the photoreceptor drum 1Y is rotated clockwise in FIG. 5 by a driving motor. The surface of the photoreceptor drum 1Y is charged uniformly at a position facing the charging member 4Y by the charging member 4Y (charging process).

When the photoreceptor drum 1Y reaches a position to receive a laser beam L emitted from an exposure unit 7 (shown in FIG. 4), an electrostatic latent image for yellow is formed thereon by exposure scanning (exposure process).

Then, the photoreceptor drum 1Y reaches a position facing the developing device 5Y, where the latent image is developed with toner into a yellow toner image (development process).

Subsequent to the developing, surface of the photoreceptor drum 1Y reaches a position facing a primary-transfer bias roller 9Y via the intermediate transfer belt 8, and the toner image is transferred therefrom onto the intermediate transfer belt 8 (primary-transfer process). After the primary-transfer process, a certain amount of toner tends to remain on the photoreceptor drum 1Y.

When the surface of the photoreceptor drum 1Y reaches a position facing the cleaning unit 2Y, a cleaning blade 2*a* of the cleaning unit 2Y mechanically collects the toner remaining on the photoreceptor drum 1Y (cleaning process). Further, when the surface of the photoreceptor drum 1Y reaches a position facing the discharger, electrical potentials remaining thereof are removed. Thus, a sequence of image forming processes performed on the photoreceptor drum 1Y is completed.

The above-described image forming processes are performed in the image forming units 6M, 6C, and 6K similarly to the yellow image forming unit 6Y. That is, the exposure unit 7 disposed beneath the image forming units 6M, 6C, and 6K directs laser beams L according to image data onto the photoreceptor drums 1M, 1C, and 1K in the respective image forming units 6M, 6C, and 6K. More specifically, the exposure unit 7 includes light sources to emit the laser beams L, multiple optical elements, and a polygon mirror that is rotated by a motor. The exposure unit 7 directs the laser beams L to the respective photoreceptor drums 1 via the multiple optical elements while deflecting the laser beams L with the polygon mirror.

Then, the toner images formed on the respective photoreceptor drums 1 through the development process are transferred therefrom and superimposed one on another on the intermediate transfer belt 8. Thus, a multicolor toner image is formed on the intermediate transfer belt 8.

As shown in FIG. 4, the intermediate transfer unit 15 includes the intermediate transfer belt 8, the four primary-transfer bias rollers 9, a secondary-transfer backup roller 12, multiple tension rollers, and a belt cleaning unit.

The intermediate transfer belt 8 is supported by the multiple rollers and is rotated in the direction indicated by an arrow shown in FIG. 4 as the secondary-transfer backup roller 12 rotates.

The four primary-transfer bias rollers 9 are pressed against the corresponding photoreceptor drums 1 via the intermediate transfer belt 8, and four contact portions between the primary-transfer bias rollers 9 and the corresponding photoreceptor drums 1 are hereinafter referred to as primary-transfer nips. Each primary-transfer bias roller 9 receives a transfer bias in the polarity opposite the polarity of toner.

While rotating in the direction indicated by the arrow shown in FIG. 4, the intermediate transfer belt 8 sequentially passes through the primary transfer nips formed between the photoreceptor drums 1 and the corresponding primary-transfer bias rollers 9. Then, the single-color toner images are transferred from the respective photoreceptor drums 1 primarily and superimposed one on another on the intermediate transfer belt 8.

Then, the intermediate transfer belt 8 carrying the multicolor toner image reaches a portion facing the secondary-transfer roller 19. The secondary-transfer roller 19 and the secondary-transfer backup roller 12 press against each other via the intermediate transfer belt 8, and the contact portion therebetween is hereinafter referred to as a secondary-transfer nip. The multicolor toner image formed on the intermediate transfer belt 8 is transferred onto a sheet P (recording medium) transported to the secondary-transfer nip (secondary-transfer process). A certain amount of toner tends to remain on the intermediate transfer belt 8 after the secondary-transfer process.

When the intermediate transfer belt 8 reaches a position facing the belt cleaning unit, the toner remaining on the intermediate transfer belt 8 is collected by the belt cleaning unit. Thus, a sequence of image forming processes performed on the intermediate transfer belt 8 is completed.

The sheet P is transported by a sheet feeder 26 provided in a lower portion of the apparatus body 100 to the secondary-transfer nip via a feed roller 27, and a pair of registration rollers 28 (i.e., registration roller pair 28).

More specifically, the sheet feeder 26 contains multiple sheets P piled one on another. The feed roller 27 rotates counterclockwise in FIG. 4 to feed the sheet P on the top contained in the sheet tray 26 toward a nip formed between the registration roller pair 28.

The registration roller pair 28 stops rotating temporarily, stopping the sheet P with a leading edge of the sheet P stuck in the nip. The registration roller pair 28 resumes rotating to transport the sheet P to the secondary-transfer nip, time to coincide with the arrival of the multicolor toner image formed on the intermediate transfer belt 8. Thus, the multicolor toner image is recorded on the sheet P.

Subsequently, the sheet P carrying the multicolor image is transported to a fixing device 20. In the fixing device 20, a fixing belt and a pressing roller apply heat and pressure to the sheet P to fix the multicolor toner image on the sheet P.

Subsequently, the sheet P is discharged by a pair of discharge rollers 29 outside the image forming apparatus 100 and stacked as an output image in a stack section 30.

Thus, a sequence of image forming processes performed in the image forming apparatus 1000 is completed.

Next, a configuration and operation of the developing device 5Y is described in further detail below with reference to FIG. 5.

The developing device 5Y includes a developing roller 51Y disposed facing the photoreceptor drum 1Y, a doctor blade 52Y disposed facing the developing roller 51Y, two conveying screws 55Y respectively disposed in developer containing compartments 53Y and 54Y, and a concentration detector 56Y to detect concentration of toner in developer G. The developing roller 51Y serves as a developer bearer. A casing of the developing device 5Y is divided, at least partially, into the developer containing compartments 53Y and 54Y. The developing roller 51Y includes a magnet roller or multiple magnets fixed in position relative to the casing of the developing device 5Y, a sleeve that rotates around the magnet roller, and the like. The developer containing compartments 53Y and 54Y contain two-component developer G consisting essentially of carrier (carrier particles) and toner (toner particles). An opening is formed on an upper side of the developer containing compartment 54Y, and the developer containing compartment 54Y is connected via the opening to a vertical toner channel 64Y.

The developing device 5Y configured as described above operates as follows.

The sleeve of the developing roller 51Y rotates in the direction indicated by an arrow shown in FIG. 5. The developer carried on the developing roller 51Y by the magnetic field generated by the magnets is transported in the circumferential direction of the developing roller 51Y as the sleeve rotates.

The ratio of toner to carrier (the concentration of toner) in the developer G contained in the developing device 5Y is adjusted within a predetermined range. More specifically, the developer replenishing device 60Y (shown in FIG. 6) supplies toner from the developer container 32Y to the developer containing compartment 54Y according to the consumption of toner in the developing device 5Y.

The toner supplied to the developer containing compartment 54Y is mixed with the developer G therein, and the developer G is circulated between the two developer containing compartments 53Y and 54Y (transported in the direction perpendicular to the surface of the paper on which FIG. 5 is drawn) while agitated by the developer conveying screws 55Y. While developer G is thus agitated, the toner particles in the developer G are charged by friction with the carrier particles and adsorbed to the carrier particles. Then, the toner particles are carried on the developing roller 51Y together with the carrier particles by a magnetic force generated on the developing roller 51Y.

The developer G carried on the developing roller 51Y is transported in the direction indicated by the arrow shown in FIG. 5 to the doctor blade 52Y. The amount of developer G on the developing roller 51Y is adjusted to a suitable amount by the doctor blade 52Y, after which the developer G is carried to a development range facing the photoreceptor drum 1Y. Then, the toner in the developer G adheres to the latent image formed on the photoreceptor drum 1Y due to the effect of the magnetic field generated in the development range. As the sleeve rotates, the developer G remaining on the developing roller 51Y reaches an upper part in the developer containing compartment 53Y and then drops from the developing roller 51Y.

Next, referring to FIGS. 6 through 9, the developer replenishing devices 60Y, 60M, 60C, and 60K are described below.

Referring to FIG. 6, supply of toner from the container mount 70 is described below.

The different color toners contained in the respective developer containers 32Y, 32M, 32C, and 32K in the container mount 70 are supplied to the corresponding developing devices 5Y, 5M, 5C, and 5K by the developer replenishing devices 60Y, 60M, 60C, and 60K (only the developer replenishing device 60Y is illustrated in FIG. 6) according to the amount of the corresponding toner consumed.

It is to be noted that the developer replenishing devices 60Y, 60M, 60C, and 60K have a similar structure, and the developer containers 32Y, 32M, 32C, and 32K have a similar structure except the color of toner used. Therefore, only the structure for yellow is described below, omitting descriptions for other colors.

To replace the developer container 32Y, initially a cover on a proximal side (on the front side of the paper on which FIG. 4 is drawn) of the apparatus body 100 shown in FIG. 4 is opened to expose the container mount 70.

The developer container 32Y is inserted and removed from the front side of the apparatus body 100 with the longitudinal direction of the developer container 32Y kept horizontal.

FIG. 7 is a perspective view that illustrates a state in which the developer containers 32Y, 32M, 32C, and 32K are inserted in the container mount 70 of the apparatus body 100.

The developer container 32Y is inserted in the direction Q shown in FIG. 7 and set in the container mount 70. In conjunction with the installation, the shutter 34*d* (shown in FIG. 6) of the developer container 32Y moves, thereby opening the toner outlet W.

When the shutter 34*d* is opened, the toner outlet W (upstream side in the direction indicated by a broken arrow shown in FIG. 6) of the developer container 32Y communicates with the supply inlet 73*w* (shown in FIG. 6) of the developer replenishing device 60Y.

Accordingly, toner is discharged from the developer container 32Y through the toner outlet W and received in toner tank 61 through the supply inlet 73*w* of the developer replenishing device 60Y.

The container body 33Y is held by the container mount 70 rotatably relative to the cap 34Y as shown in FIG. 6 and rotated by the driving unit 91 that includes a driving motor, a driving gear 81, and the like.

As the container body 33Y rotates, the toner contained in the container body 33Y is transported in the longitudinal direction by the spiral protrusion 33*b* formed in the container body 33Y and is discharged from the toner outlet W.

That is, the driving unit 91 rotates the container body 33Y of the developer container 32Y as required, thus supplying toner to the toner tank 61Y. It is to be noted that the developer containers 32Y, 32M, 32C, and 32K are replaced when the respective service lives thereof have expired, that is, almost all toner contained therein is consumed. As described above, the cover of the apparatus body 100 is opened at that time.

Referring to FIG. 6, the developer replenishing device 60Y includes the container mount 70, the toner tank 61Y, a toner conveying screw 62Y, a toner agitator 65Y, a toner end detector 66Y, and the driving unit 91. The toner end detector 66Y can communicate with a controller 90 of the image forming apparatus 1000, which controls the driving unit 91.

The toner tank 61Y is positioned beneath the toner outlet W of the developer container 32Y and stores toner discharged through the toner outlet W. A bottom portion of the toner tank 61Y is connected to an upstream side of the toner conveying screw 62Y in a direction in which the developer G is transported (hereinafter "developer conveyance direction").

The toner end detector 66Y is disposed on a side wall of the toner tank 61Y at a predetermined height from the bottom of the toner tank 61Y. The toner end detector 66Y detects that the amount of toner stored in the toner tank 61Y has fallen to or below a predetermined amount.

For example, a piezoelectric sensor can be used as the toner end detector 66Y. When the controller 90 recognizes that the amount of toner stored in the toner tank 61Y is less than the predetermined amount using the toner end detector 66Y, the controller 90 causes the driving unit 91 (including the driving gear 81) to rotate the container body 33Y of the developer container 32Y for a predetermined period, thereby supplying toner to the toner tank 61Y.

If the toner end detector 66Y continues to report "toner end" even when this operation is repeated, the controller 90 deems the developer container 32Y empty (the end of toner). Then, a display of the apparatus body 100 shows a message to invite users or operators to replace the developer container 32Y.

The toner agitator 65Y is disposed in a center portion inside the toner tank 61Y, that is, adjacent to the toner end detector 66Y, for preventing toner from coagulating inside the toner tank 61Y. The toner agitator 65Y includes a flexible member provided on a shaft and rotates clockwise in FIG. 6, thus stirring the toner in the toner tank 61Y.

In addition, a tip of the flexible member of the toner agitator 65Y slidably contacts a detection surface of the toner end detector 66Y periodically with rotation cycle of the toner agitator 65Y, thus preventing toner from adhering to the detection surface of the toner end detector 66Y. Accordingly, decreases in the detection accuracy can be prevented or inhibited.

Although not shown, the toner conveying screw 62Y transports the toner stored in the toner tank 61Y obliquely upward. More specifically, the toner conveying screw 62Y linearly conveys the toner from the bottom side of the toner tank 61Y to the upper side of the developing device 5Y. Then, the toner thus conveyed by the toner conveying screw 62Y drops under its own weight through the vertical toner channel 64Y and is supplied to the developer containing compartment 54Y in the developing device 5Y as shown in FIG. 5.

Figure 8:
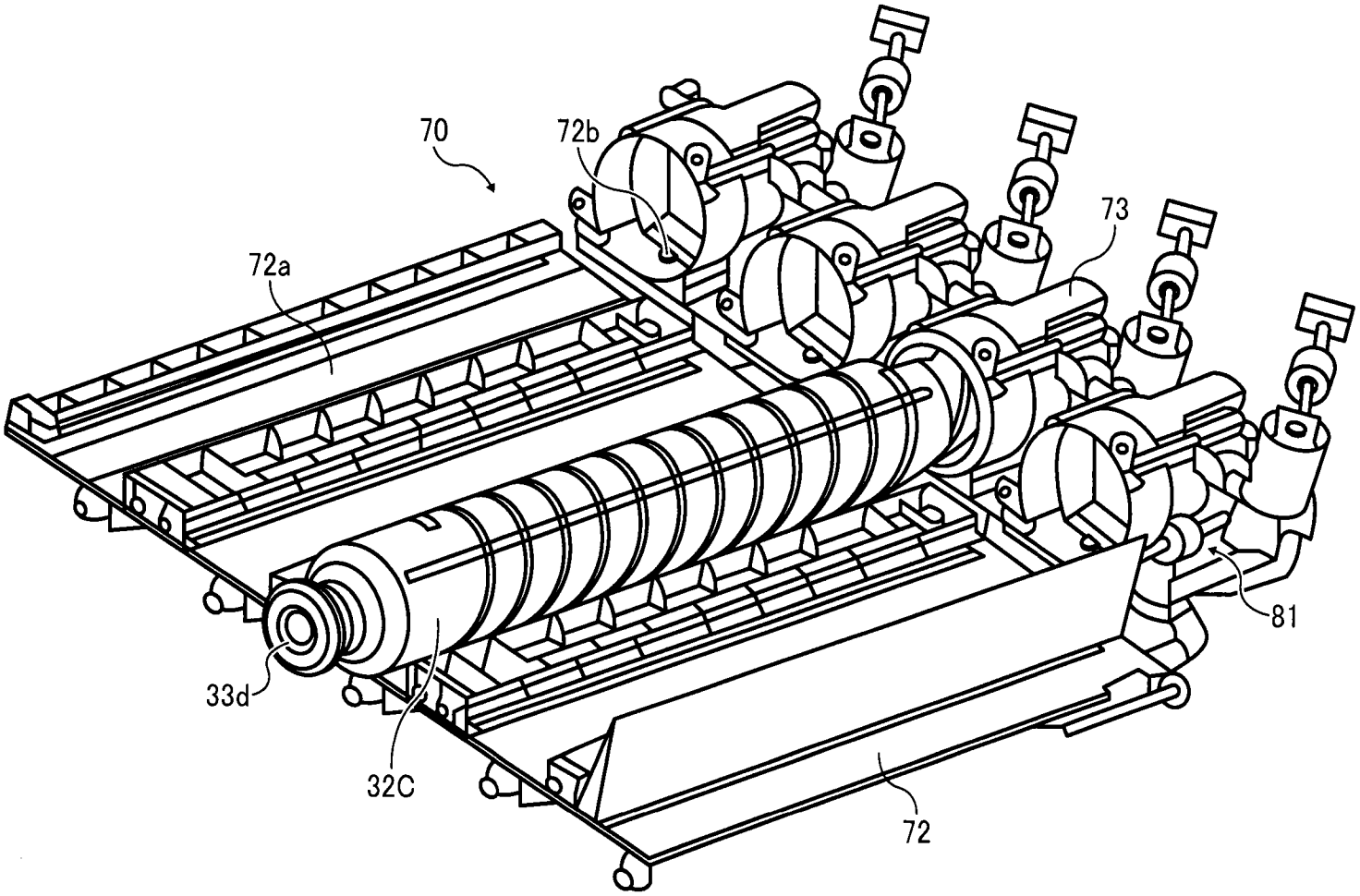
FIG. 8 is a perspective view that illustrates a state in which a single developer container is mounted in the container mount shown in FIG. 8.

Referring to FIGS. 7 and 8, the container mount 70 is incorporated in the apparatus body 100 and includes a cap holder 73 that holds the caps 34 of the respective developer containers 32, a bottle holder 72 that holds the container bodies 33 of the respective developer containers 32, and the insertion section 71. The four developer containers 32 are inserted into and removed from the container mount 70 from four insertion openings formed in the insertion section 71.

The user holds a handle 33*d* and keeps the longitudinal direction of the developer container 32Y horizontal when installing the developer container 32Y into the container mount 70. When being inserted through the insertion section 71, the cap 34Y is situated at the leading end of the developer container 32Y.

The developer container 32Y inserted from the insertion section 71 slides on the bottle receiving face 72*a* of the bottle holder 72 and is pressed to the cap holder 73.

As shown in FIG. 8, the bottle holder 72 includes four bottle receiving faces 72*a* for the respective colors, and the developer container 32Y is slid on the corresponding bottle receiving face 72*a* from the left to the cap holder 73 on the right in FIG. 8.

In the cap holder 73, sockets are formed for the caps 34Y, 34M, 34C, and 34K, respectively. When the developer containers 32Y, 32M, 32C, and 32K are inserted into the container mount 70 in the direction indicated by arrow Q shown in FIG. 7, the caps 34Y, 34M, 34C, and 34K are held at the positions by the respective sockets not to rotate.

In FIG. 8, the bottle holder 72 is provided with the bottle receiving faces 72*a* and pressing members 72*b* for canceling retention.

The bottle receiving face 72*a* serves as a slide face on which the developer container 32Y slides when the developer container 32Y is installed into or released from the container mount 70 and also functions as a holder to hold the rotatable container body 33Y after the developer container 32Y is fully set.

The pressing member 72*b* shown in FIG. 8 is used to move the shutter 34*d* from the closing position to the open position to open the toner outlet W in conjunction with installation of the developer container 32Y shown in FIG. 1. This operation is described in further detail with reference to FIGS. 10 through 13C.

The pressing member 72*b* is a trapezoidal rib projecting toward the shutter 34*d* and projecting from the bottle receiving face 72*a* upward.

Figure 9:
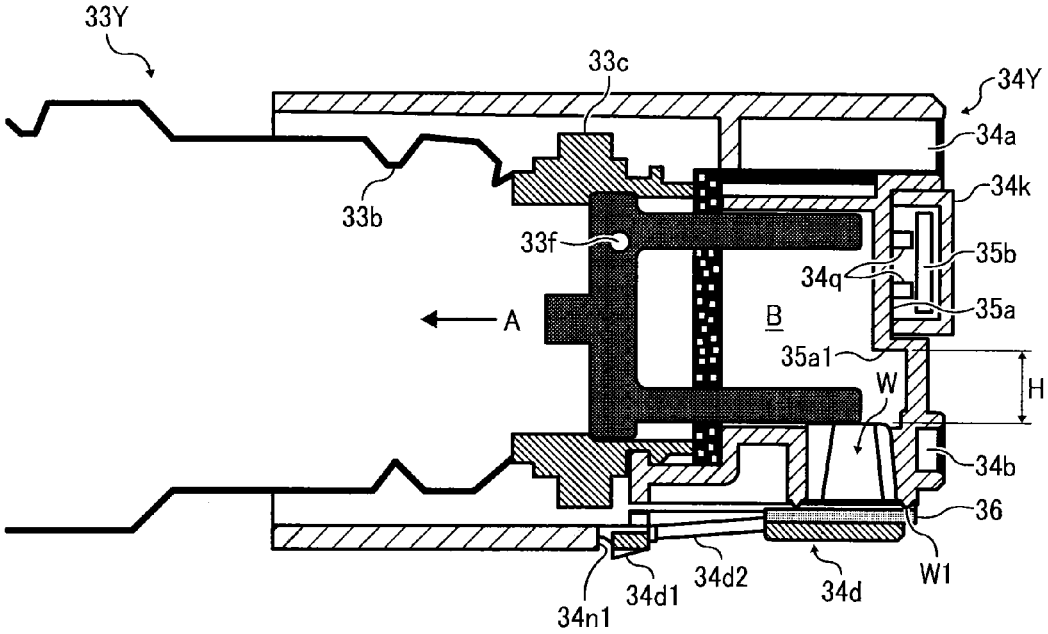
FIG. 9 is a cross-sectional view of the cap of the developer container according to an embodiment.

In the vertical direction, the chip setting 34*k* provided to the developer container 32Y shown in FIG. 1 is positioned higher than the toner outlet W opened and closed by the shutter 34*d* (described later with reference to FIG. 11) so that the chip setting 34*k* can be away from the toner outlet W. In FIG. 9, a bottom 35*a*1 of the recess 35*a* is positioned at a height H from the toner outlet W for ease of understanding. Additionally, a wall is formed at the peripheral of the quadrate recess 35*a*.

With this arrangement, a part of the recess 35*a* becomes less likely to overlap with the toner outlet W in the transverse direction. In other words, the bottom 35*a*1 of the recess 35*a* is inhibited from approaching the toner outlet W so that the bottom 35*a*1 does not block a part of the toner outlet W and hinder the discharge of toner.

Further, the relative positions of the toner outlet W and the recess 35 are determined such that, even when toner scatters outside from the toner outlet W of the developer container 32Y, the scattering toner does not reach the connector against the gravity, and that the wall blocks the scattering toner to prevent poor contact, caused by toner adhering to the connector, and consequent defective communication. The recess 35*a* is on the side of the first positioning hole 34*a*.

By contrast, as shown in FIG. 9, the gear 33*c*, which rotates together with the container body 33Y, and a mouth portion A (including an opening) are positioned in the head portion of the container body 33Y (shown in FIG. 1) on one side in its longitudinal direction.

The mouth portion A is situated on the head of the container body 33Y that is on the leading side when the developer container 32Y is inserted into the container mount 70. The mouth portion A is for discharging toner from the container body 33Y to a space or hollow B inside the cap 34Y.

The container body 33Y is rotated to convey toner from the container body 33Y to the hollow B in the cap 34Y in accordance with consumption of toner in the image forming apparatus 1000.

Out of the insertion portion of the cap 34Y of the developer container 32Y shown in FIG. 1, a peripheral portion 34P1 adjacent to the cutout 34P0 in the axial direction in FIG. 10 is smaller in external diameter than a peripheral portion 34P2 that is not adjacent to the cutout 34P0 in the circumferential direction. Specifically, in FIG. 10, an external diameter D1 of the peripheral portion 34P1 is smaller than an external diameter D2 of the peripheral portion 34P2.

By reducing the external diameter of the peripheral portion 34P1 adjacent to the cutout 34P0 in the axial direction from the external diameter of other portions in the circumferential direction, a tooth flank that meshes with the gear 33*c* in the axial direction can be made less likely to interfere with the periphery of the insertion portion. The gear 33*c* is exposed through the cutout 34P0. Consequently, the engagement between the gear 33*c* and the tooth flank moving in the axial direction can be smooth without being obstructed by the insertion portion.

Figure 20:
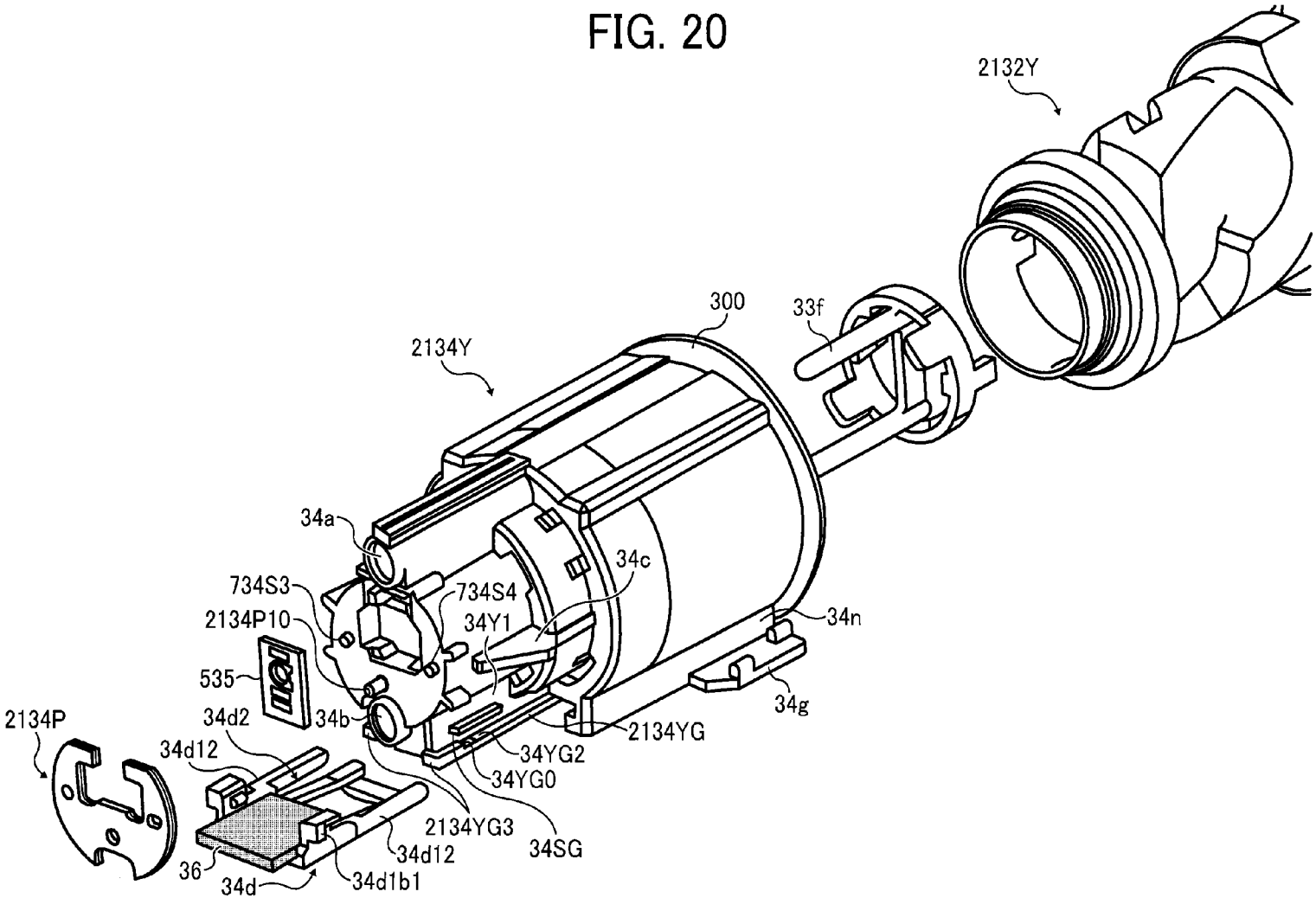
FIG. 20 is an exploded perspective view of the cap shown in FIG. 18.

It is to be noted that in FIGS. 10 and 20, reference character 34YG0 represents a stopper constructed of a step at the end of the guide rail 34YG. FIG. 20 illustrates a variation and the configuration of a main portion thereof is similar to that shown in FIG. 10. The stoppers 34YG0 are configured such that slide protrusions 34*d*1*c* (shown in FIGS. 12B and 12C) provided to the shutter 34*d* abut against the stoppers 34YG0 and accordingly the shutter 34*d* is prevented from moving further and coming off from the developer container 32Y. It is to be noted that FIG. 20 illustrates a configuration in which the structure (i.e., the recess 35*a*) to set the ID chip 35 is different from that shown in FIG. 10.

A rib 34SG (described in detail with reference to FIG. 20) is provided above the guide rail 34YG shown in FIG. 10. The rib 34SG parallels the guide rail 34YG and is at a distance from the guide rail 34YG.

Figure 14:
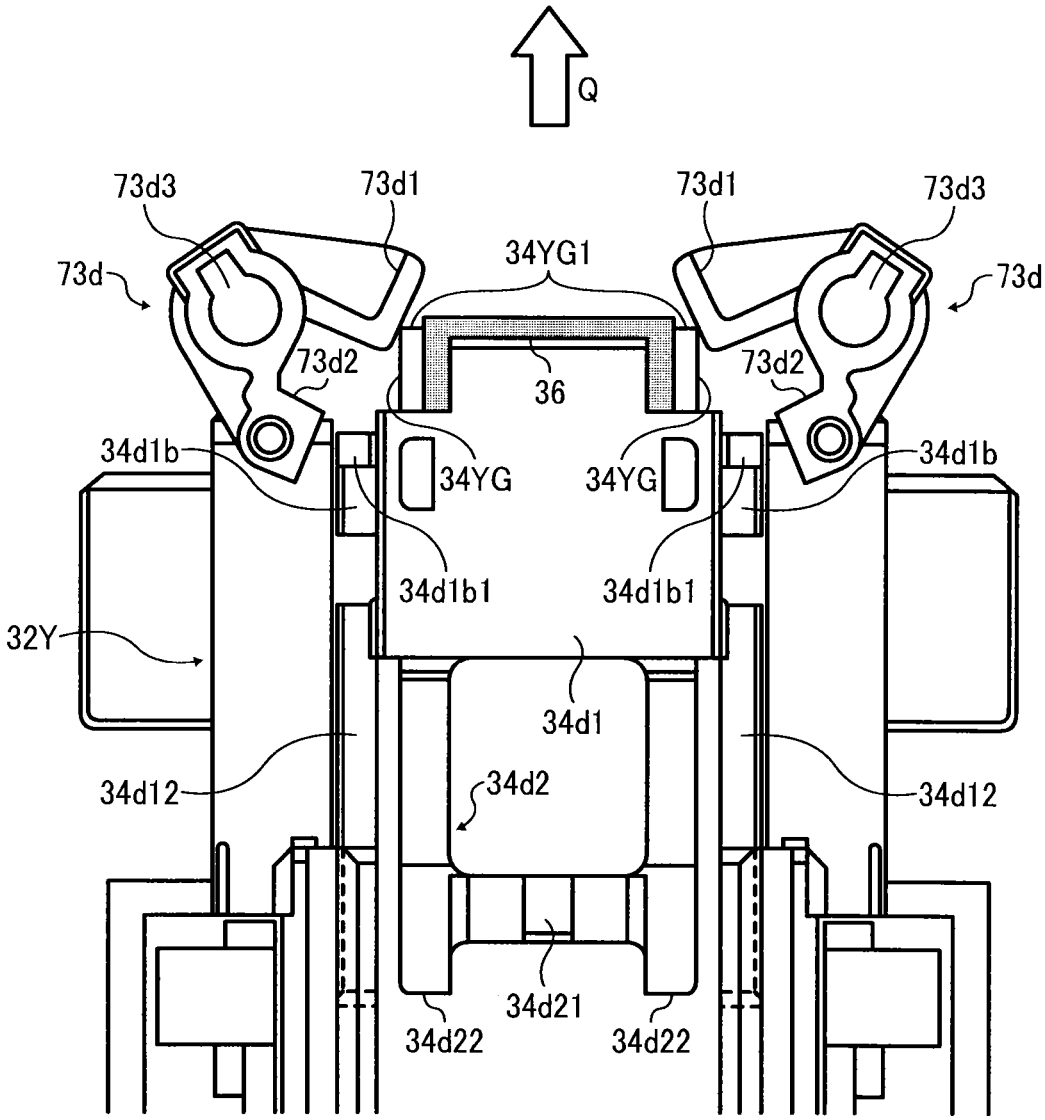
FIG. 14 is a plan view that illustrates the relation between the shutter and a shutter retainer according to an embodiment.
Figure 15:
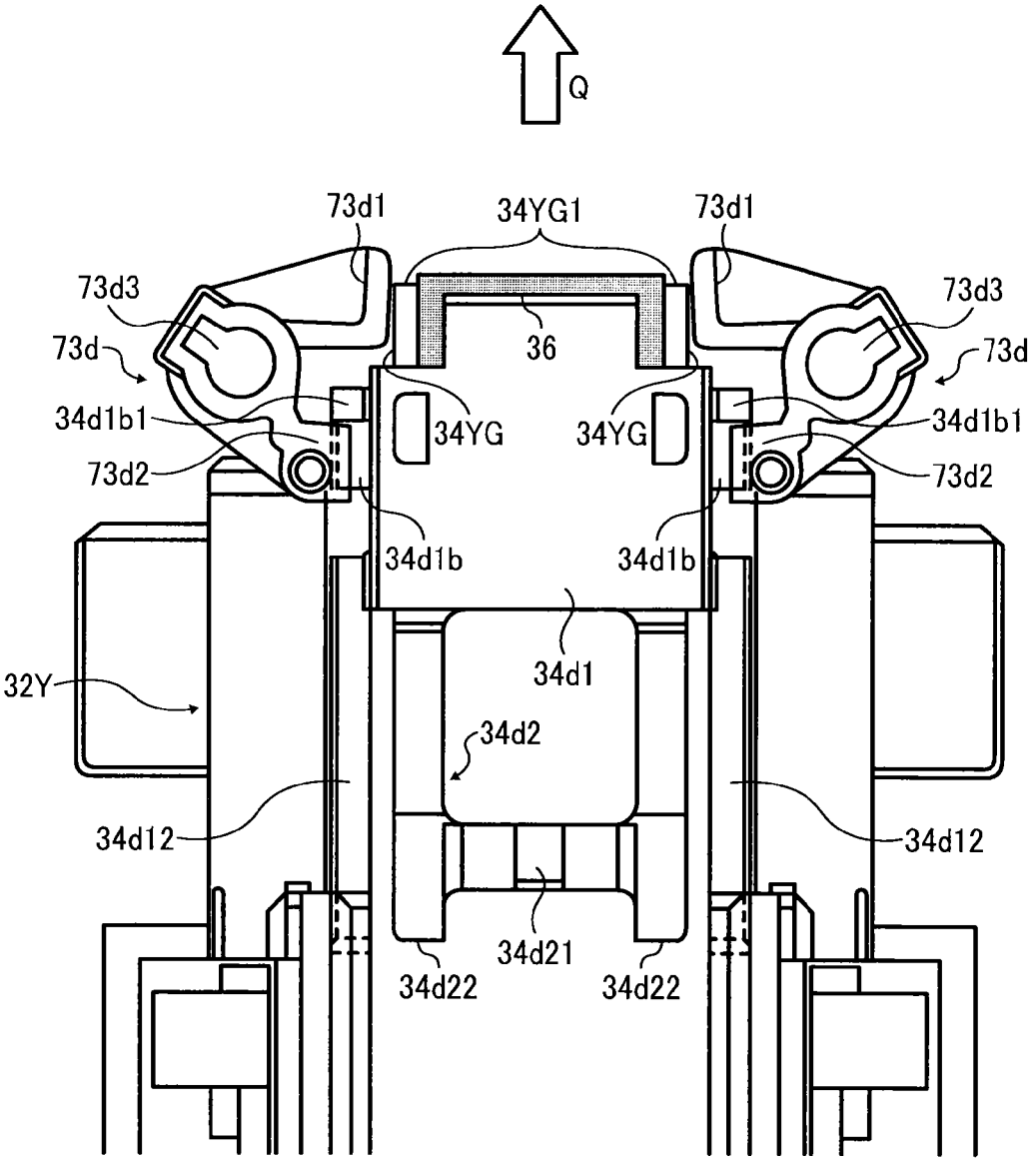
FIG. 15 is a plan view illustrating a state of the shutter retainer shown FIG. 14.
Figure 16:
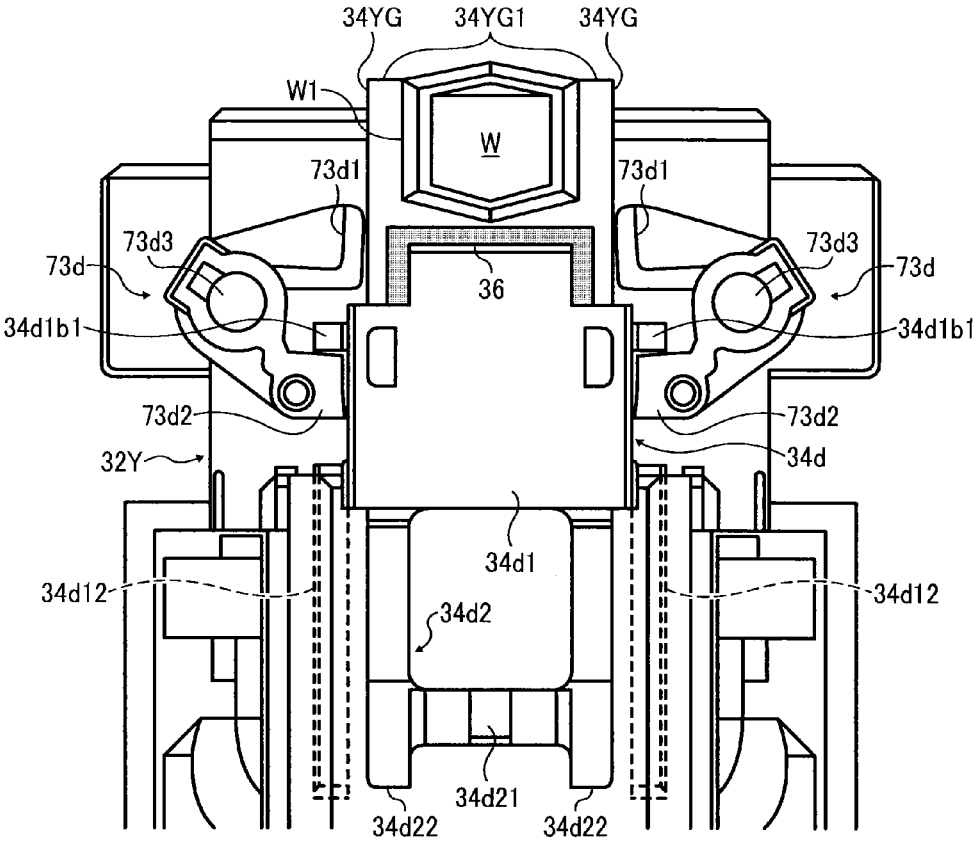
FIG. 16 is a plan view illustrating a state of the shutter retainer changed from the state shown FIG. 15.

A pair of shutter retainers 73*d*, described later with reference to FIGS. 14 through 16, is provided in the container mount 70 (the cap holder 73 in particular) of the apparatus body 100 (hereinafter also "shutter retainer 73*d* on the body-side") to retain the shutter 34*d* at the closing position. The rib 34SG is configured to prevent clamping arms (first and second arms 73*d*1 and 73*d*2) of the shutter retainers 73*d* from entering between the cylindrical circumferential surface of the cap 34Y and the guide rail 34YG.

In the configuration shown in FIG. 20, a shutter projection 34YG2 is provided on the upper face of a guide rail 2134YG at a position where the shutter 34*d* reaches before contacting the stopper 34YG0. The shutter projection 34YG2 is for restricting the movement of the shutter 34*d* being at the close position.

In the configuration shown in FIG. 8, by gripping the handle 33*d* disposed at the rear end of the container body 33Y in the insertion direction, the user or operator can insert and remove the developer container 32Y from the container mount 70.

In FIG. 10, the narrow box portion 34Y1 is formed in the small cylindrical portion of the cap 34Y. As shown in FIG. 11B, the toner outlet W for discharging toner is formed inside the narrow box portion 34Y1. Toner discharged from the mouth portion A of the container body 33Y) can drop its own weight through the toner outlet W outside the developer container 32Y. The toner outlet W communicates with the hollow B shown in FIG. 9.

As shown in FIG. 11B, the toner outlet W is hexagonal and has a constant channel area. The lower circumferential side of the hollow B shown in FIG. 9 communicates with the toner outlet W. With this configuration, toner discharged from the mouth portion A of the container body 33Y to the hollow B in the cap 34Y can drop through the hexagonal toner outlet W smoothly outside (to the toner tank 61Y) under its own weight.

The toner outlet W is surrounded by a rib W1 projecting to the shutter seal 36 of the shutter 34*d* as shown in FIGS. 9 and 11B.

The rib W1 can fold back (turn back) an end portion of the shutter seal 36 and also can enhance contact with the shutter seal 36 by pressing the rest of the shutter seal 36. Further, the shutter seal 36 can block toner that is about to leak from the toner outlet W.

Figure 11A:
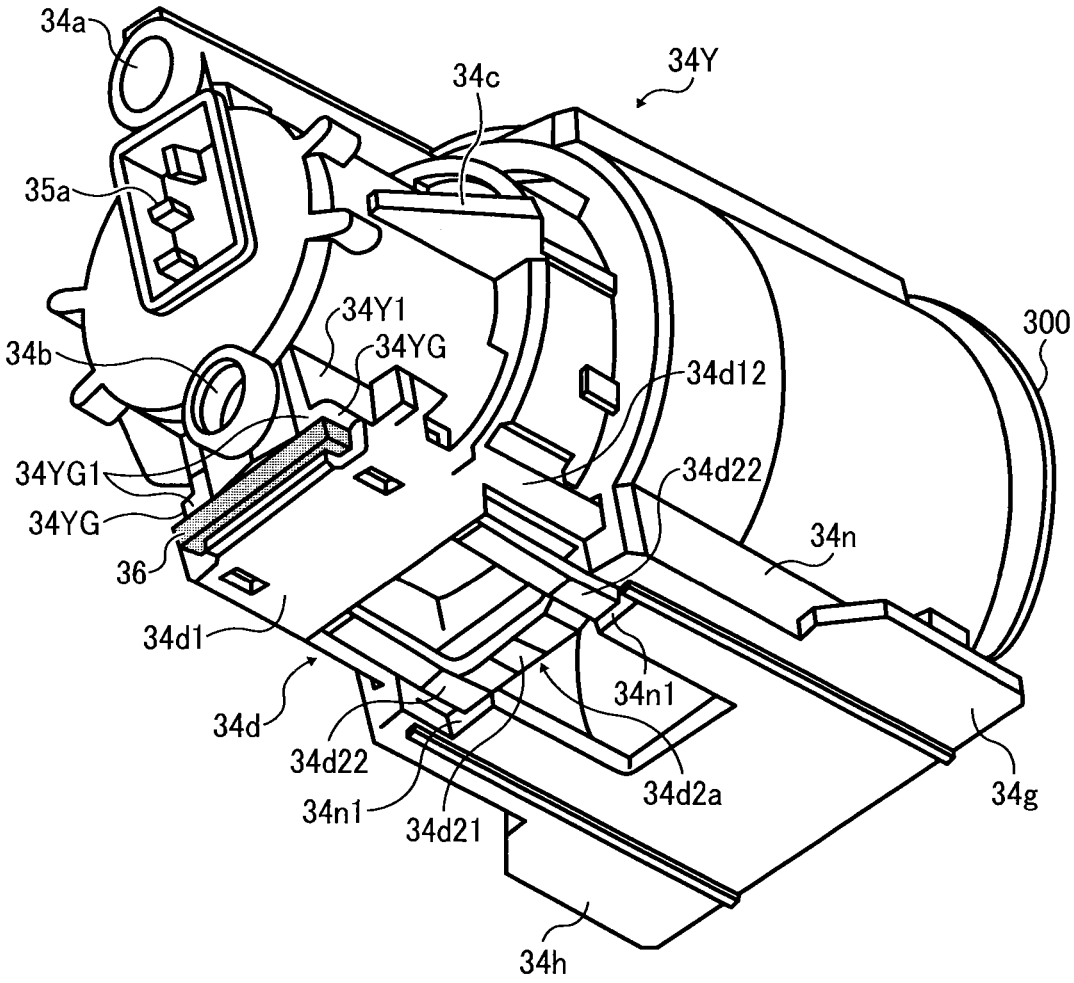
FIGS. 11A and 11B are perspective views of the cap as viewed from the bottom of the shutter that is closed.
Figure 11B:
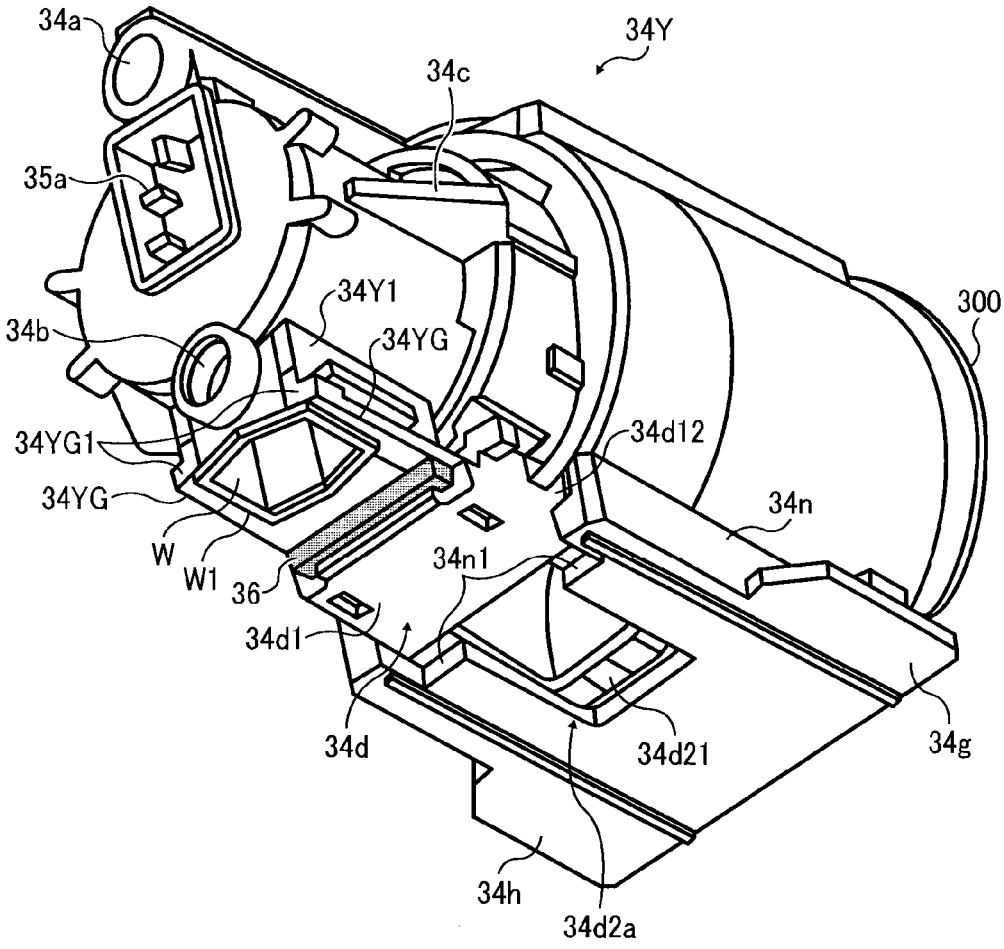

In FIGS. 11A and 11B, the shutter 34*d* is slidably held on the bottom of the narrow box portion 34Y1 positioned beneath the cap 34Y. The shutter 34*d* is for opening and closing the toner outlet W in conjunction with installation and removal of the developer container 32Y to the container mount 70.

Figure 12A:
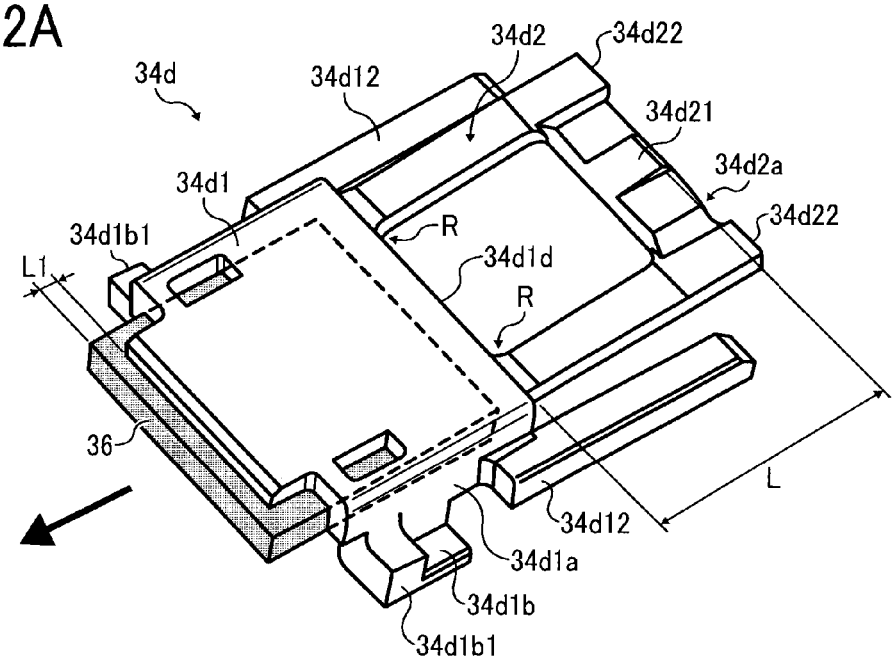
FIGS. 12A, 12B, and 12C illustrate a configuration of the shutter shown in FIG. 10.
Figure 12B:
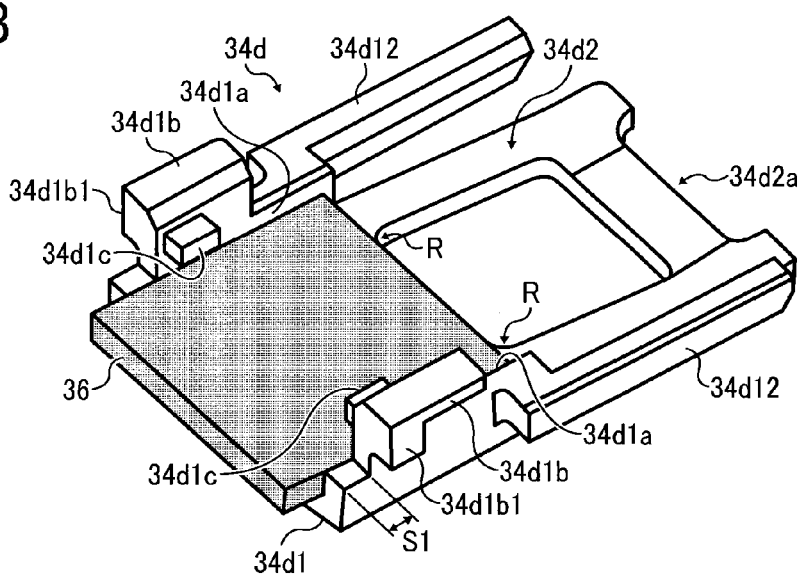
Figure 12C:
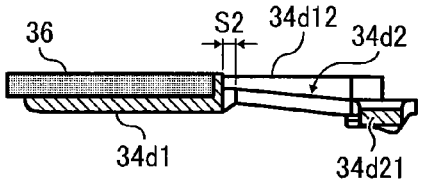

FIGS. 12A through 12C illustrates a configuration of the shutter 34*d*. FIG. 12A is a perspective view of the shutter 34*d* as viewed from the lower side, and FIG. 12B is a perspective view of the shutter 34*d* as viewed from the upper side.

For example, the shutter 34*d* is formed of resin such as polystyrene and includes a planar shutter body 34*d*1 and an elastic deformable portion 34*d*2 projecting from the shutter body 34*d*1. The deformable portion 34*d*2 is thinner than the shutter body 34*d*1 to be elastic. The shutter body 34*d*1 is provided with longitudinal walls 34*d*1*a*, standing on either outer sides of the shutter body 34*d*1, and a pair of shutter sliders 34*d*12 projecting therefrom.

Each longitudinal wall 34*d*1*a* is provided with the slide protrusion 34*d*1*c* and an L-shaped engaging portion 34*d*1*b*. The slide protrusions 34*d*1*c* face each other and project to each other. The engaging portion 34*d*1*b* is provided to the outer side of the longitudinal wall 34*d*1*a* on the opposite side of the slide protrusions 34*d*1*c*.

The engaging portion 34*d*1*b* includes a planar upper portion that extends in the direction in which the shutter 34*d* moves, and a projection 34*d*1*b*1 extends downward from a front portion of the planar upper portion in the installation direction. The projection 34*d*1*b*1 engages the shutter retainer 73*d*.

The shutter sliders 34*d*12 are each prisms projecting from a face of the longitudinal wall 34*d*1*a* on the same side as the engaging portion 34*d*1*b*. The shutter sliders 34*d*12 extend to the back side in the direction indicated by an arrow shown in FIG. 12A, in which the shutter 34*d* moves to close the toner outlet W.

As shown in FIG. 12B, the projection 34*d*1*b*1 of the engaging portion 34*d*1*b* is shifted a distance S1 from the front end of the shutter body 34*d*1, creating a cutout having a length 51. The cutout is for preventing interference with the second arm 73*d*2 (shown in FIG. 14) of the shutter retainer 73*d* on the body-side when the second arm 73*d*2 starts rotating as described later with reference to FIG. 14 and subsequent drawings.

In the shutter 34*d*, the deformable portion 34*d*2 is cantilevered as shown in FIGS. 12A to 12C. Corners R (shown in FIGS. 12A and 12B) inside base ends of the deformable portion 34*d*2 connected to the shutter body 34*d*1 are curved in arc so that stress is not localized at the time of deformation.

Additionally, as shown in FIG. 12C, the deformable portion 34*d*2 includes horizontal portions (represented by reference character S2) on the base side connected to the shutter body 34*d*1 and an inclined portion extending from the end of the horizontal portion. It is to be noted that the engaging portion 34*d*1*b* is omitted in FIG. 12C. Compared with a configuration in which an inclined base end of the deformable portion 34*d*2 is directly connected to the shutter body 34*d*1, the configuration shown in FIG. 12C is advantageous in that, when the base side of the deformable portion 34*d*2 swings, concentration of stress to the connection between the shutter body 34*d*1 and the inclined base end of the deformable portion 34*d*2 can be avoided.

The deformable portion 34*d*2 is constructed of a cantilevered piece supported by the shutter body 34*d*1 and extends (for a length L in FIG. 12A) to the rear side in the insertion direction of the developer container 32Y. The deformable portion 34*d*2 is inclined down toward the rear side in the insertion direction.

The free ends of the deformable portion 34*d*2 are bridged together via a connection plate 34*d*2*a*. A stopper release member 34*d*21 is provided at a center position in the bridging direction of the connection plate 34*d*2*a*. The stopper release member 34*d*21 is disposed to face the pressing member 72*b* (shown in FIG. 8) that is a trapezoidal rib provided to the cap holder 73. A stopper 34*d*22 is provided on either side in the bridging direction. The stopper 34*d*22 is designed to retain the shutter 34*d* not to open the toner outlet W unintentionally.

In FIG. 12A, the stopper release member 34*d*21 is triangular in cross section. The stopper release member 34*d*21 changes the posture of the deformable portion 34*d*2 from an inclined position to a horizontal position by stepping onto the pressing member 72*b* (shown in FIG. 8) of the cap holder 73. In conjunction with this operation, the stopper release member 34*d*21 can cancel the engagement between the stopper 34*d*22 and an end face 34*n*1 (shown in FIGS. 11A and 11B) at the wide box portion 34*n* on the bottom of the cap 34Y. This operation enables the shutter 34*d* to move to open or close the toner outlet W.

In FIGS. 11A and 11B, the end face 34*n*1 positioned at the wide box portion 34*n* is provided for restricting the movement of the shutter 34*d* in the direction from the position to close the toner outlet W toward the position to open the toner outlet W. A configuration and effects relating to the movement restriction are described below.

Figure 13A:
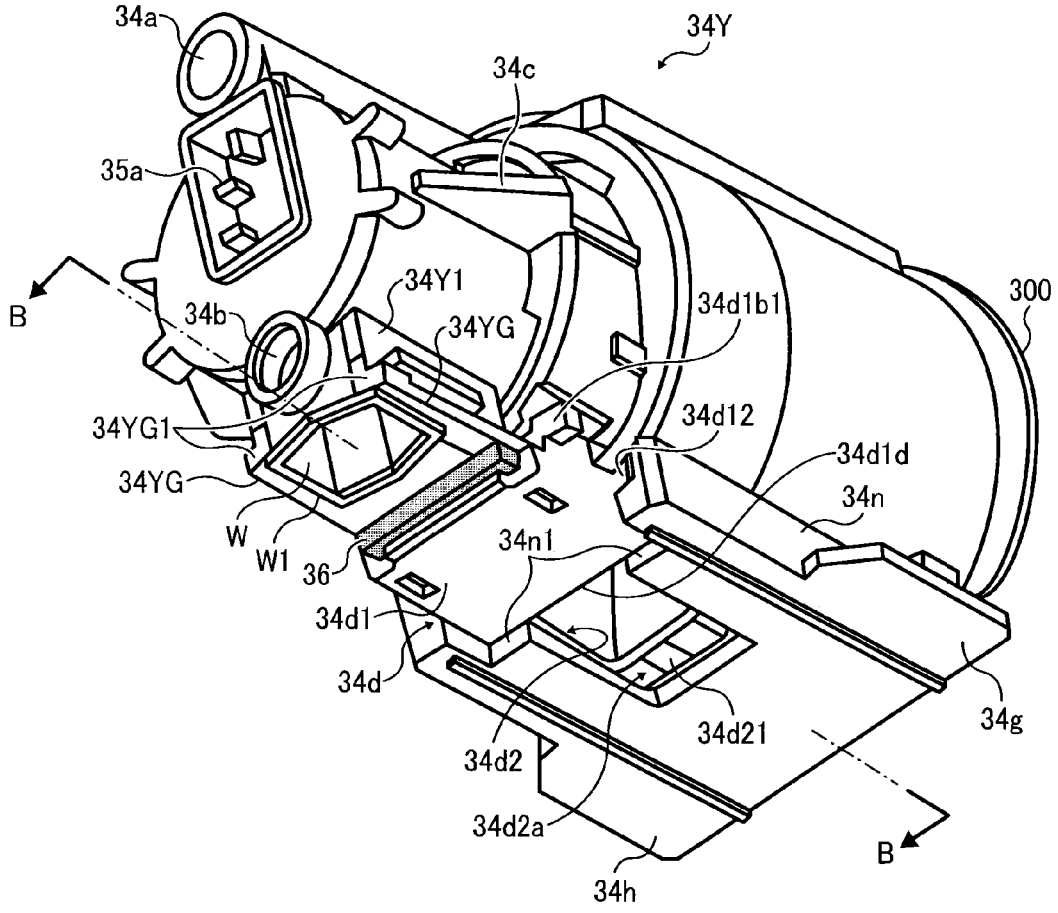
FIG. 13A is another perspective view of the cap as viewed from the bottom of the shutter that is open.
Figure 13B:
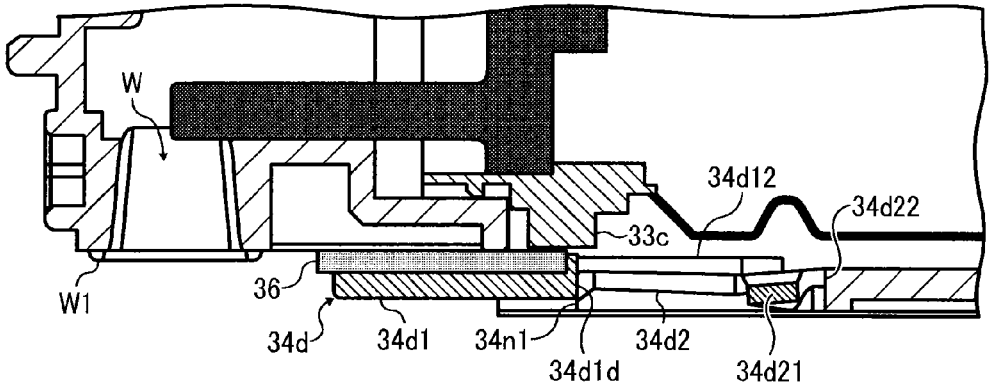
FIGS. 13B and 13C illustrate a cross section of the cap in which the shutter is open.
Figure 13C:
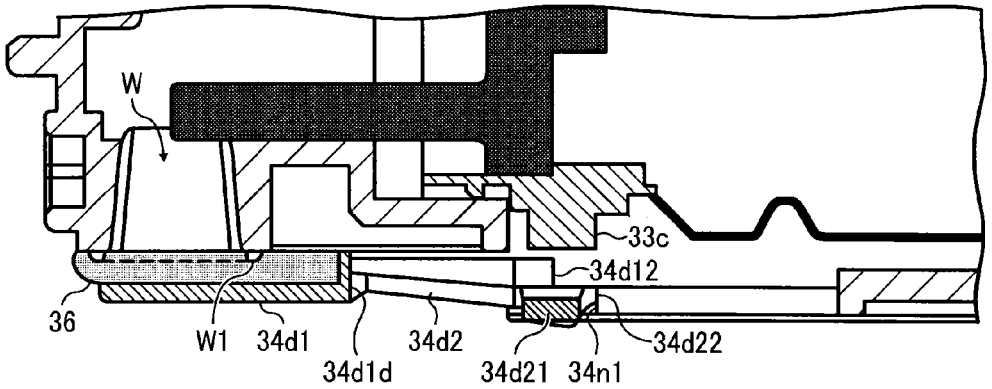

FIGS. 13B and 13C illustrate the relation between the end face 34*n*1 and the stopper 34*d*22 of the deformable portion 34*d*2.

In the state shown in FIG. 13C, in which the toner outlet W is closed, the deformable portion 34*d*2 of the shutter 34*d* is in an inclined posture as an initial state. With this configuration, the stopper 34*d*22 at the inclined free end faces the end face 34*n*1. As a result, the shutter 34*d* is prevented from moving on its own accord and kept at the closing position so that the toner outlet W is not opened unintentionally.

Additionally, reference character 34*d*1*d* (shown in FIGS. 13A to 13C) represents a front end of the shutter body 34*d*1 in the direction in which the shutter 34*d* moves to the open position. When the shutter 34*d* moves in the direction to open the toner outlet W, the front end 34*d*1*d* of the shutter body 34*d*1 abuts against the end face 34*n*1 as shown in FIGS. 11B and 13B. With this configuration, the position of the shutter body 34*d*1 can be determined. It is to be noted that FIG. 13C illustrates a case in which the shutter 34*d* moves in the direction to close the toner outlet W. In this case, the free end of the deformable portion 34*d*2 is inclined, and accordingly the stopper 34*d*22 at the free end faces the end face 34*n*1. Thus, the shutter 34*d* is prevented from moving unless the stopper release member 34*d*21 is pushed up.

The shutter seal 36 is flat and rectangular parallelepiped. The shutter seal 36 is designed such that the end thereof is folded back by abutting against the rib W1 shown in FIG. 8 and that the rest of the shutter seal 36 presses against the rib W1. The shutter seal 36 is an elastic seal formed with a flexible material capable of deforming toward the toner outlet W in a frictional contact state. For example, high-density microcell urethane sheet can be used for its surface slidability and capability to maintain elasticity.

Regarding the length of the shutter seal 36, the front end of the shutter seal 36 in the closing direction of the shutter 34*d* projects outward beyond the end of the shutter body 34*d*1 by a length L1 shown in FIG. 12A. The projecting portion of the shutter seal 36 can be folded back when abutting against the rib W1 provided at the periphery of the toner outlet W.

The shutter 34*d* can be housed inside the wide box portion 34*n* beneath the large-diameter cylindrical portion of the cap 34Y and slidable therein.

Out of the four sides (i.e., the vertical sides in FIGS. 1, 11A, and 11B) of the wide box portion 34*n*, two sides facing the longitudinal direction (i.e., the axial direction of the cylindrical member of the cap 34Y) are open. In particular, a substantial area of the face on the side of the toner outlet W is replaced by a horizontally extending opening, and the side face is present only at a bottom corner. This opening is shaped as if, in the longitudinal direction of the wide box portion 34*n*, the side face on the side of the toner outlet W and the bottom face are cut off.

By contrast, with reference to FIGS. 11A, 11B, and 13A, the pair of lateral protrusions 34*c* is formed on either lateral side of the cap 34Y to restrict the rotational position of the cap 34Y in the apparatus body 100.

On the outer circumferential face of the moderate cylindrical portion, the lateral projections 34*c* are positioned on both sides in the direction perpendicular to the vertical arrangement direction of the first and second positioning holes 34*a* and 34*b* on an identical plane. Each lateral projection 34*c* is triangular in plan view, and its apex is positioned such that the outer end in the lateral direction moves away from the outer circumferential face of the moderate cylindrical portion from the head side of the cap 34Y toward the rear side.

Each lateral projection 34*c* has two inclined faces respectively on the head side and the rear side with reference to the apex. The rising angle of the inclined face on the rear side is greater than the rising angle of the inclined face on the head side.

The cap holder 73*a* includes a pressing member configured to sandwich the lateral projection 34*c* upon application of elastic force, and the inclined face on the head side can move while being in contact with the pressing member of the cap holder 73*a*. That is, when the portion whose inclination is smaller (i.e., a gradient face) faces the pressing member as the lateral projection 34*c* is moved toward the pressing member, the gradient face can enter the pressing member without resisting. When the apex on the gradient face overstrides the pressing member, the inclined face on the rear side is latched on the pressing member since the inclination thereof is greater than the tapered face. Immediately after the lateral projection 34*c* passes over the pressing member, resistance from the pressing member decreases abruptly. Thus, resistance, that is, clicking sensation, arises when the lateral projection 34*c* fits in the pressing member.

In the present embodiment, in the lateral projection 34*c*, the inclined face on the head side has an inclination of 30°, and the inclined face on the rear side has an inclination of 45°, for example.

By contrast, the shutter 34*d* is retained at the closing position to close the toner outlet W by the shutter retainer 73*d* on the body-side shown in FIGS. 14 to 16. The shutter retainer 73*d* on the body-side is provided for preventing the developer container 32Y from being removed from the apparatus body 100 before the shutter 34*d* fully closes the toner outlet W.

In FIG. 14, the shutter retainer 73*d* on the body-side is disposed in the bottom portion of the cap holder 73 and upstream from the toner outlet W in the installation direction of the developer container 32Y.

In FIG. 14, the shutter retainers 73*d* each hoof-shaped are arranged in the lateral direction in FIG. 14 facing each other.

Each shutter retainer 73*d* is rotatable around a support shaft 73*d*3 in which a bias member such as a torsion coil spring is provided.

The shutter retainer 73*d* includes the first arm 73*d*1 at one end thereof and the second arm 73*d*2 at the other end thereof.

In opening and closing movements of the shutter 34*d* of the developer container 32Y, the projections 34*d*1*b* of the shutter 34*d* are clamped by the second arms 73*d*2 of the shutter retainers 73*d*. Then, as the vertical face (facing the first arm 73*d*1 in FIG. 15) of the guide rail 34YG (shown in FIGS. 10, 11A, 11B, and 13A) of the cap 34Y is clamped by the first arm 73*d*1 as shown in FIG. 15, postures of the shutter 34*d* and the cap 34Y in the cap holder 73 can be determined during the opening and closing movements of the shutter 34*d*. Thus, opening and closing movements of the shutter 34*d* can be smooth.

FIGS. 14 through 16 illustrate movement of the shutter retainers 73*d* in conjunction with opening and closing movements of the shutter 34*d*.

As shown in FIG. 14, to open the shutter 34*d*, initially, the first arms 73*d*1 contact ends 34YG1 (shown in FIGS. 10, 11A, 11B, and 13A) of the guide rails 34YG of the shutter 34*d* as the developer container 32Y is moved in the insertion direction indicated by arrow Q in FIGS. 14 and 15. Subsequently, the second arm 73*d*2 contacts the projection 34*d*1*b*1 of the engaging portion 34*d*1*b* of the shutter 34*d*.

As shown in FIG. 15, as the developer container 32Y is moved further in the insertion direction Q, the shutter retainer 73*d* rotates around the support shaft 73*d*3.

As the shutter retainer 73*d* rotates, the first arm 73*d*1 thereof clamps the vertical face of the guide rail 34YG of the cap 34Y. Then, while engaging the projection 34*d*1*b*1 of the engaging portion 34*d*1*b*, the second arm 73*d*2 faces and contacts the side wall of the shutter body 34*d*1 where the base end of the engaging portion 34*d*1*b* is situated. Thus, the second arm 73*d*2 clamps the side wall.

Subsequently, the shutter 34*d* contacts the wall 73 surrounding the supply inlet 73*w* (shown in FIG. 6) formed in the cap holder 73 and is prevented from moving further in the insertion direction Q. Then, the vertical face of the guide rail 34YG is clamped by the first arm 73*d*1, and movement of the shutter 34*d* in the cap holder 73 is restricted. That is, the shutter 34*d* does not move absolutely in the longitudinal direction.

As the developer container 32Y moves further in the insertion direction Q in the state in which the movement of the shutter 34*d* is restricted, the shutter 34*d* moves relative to the cap 34Y moving in the insertion direction Q. As the cap 34Y reaches a position downstream from the retained shutter 34*d* in the insertion direction Q, the toner outlet W is opened as shown in FIG. 16.

At that time, as shown in FIG. 16, the first arm 73*d*1 clamps the vertical face of the cap 34Y, and the second arm 73*d*2 engages the projection 34*d*1*b*1 of the engaging portion 34*d*1*b* of the shutter 34*d*. Thus, the shutter 34*d* is opened while being clamped. Thus, the postures of the shutter 34*d* and the cap 34Y in the cap holder 73 are determined, and smooth opening of the shutter 34*d* can be available.

By contrast, in removal of the developer container 32Y from the container mount 70, the above-described processes are performed in reverse. That is, as the shutter 34*d* closes the toner outlet W, the shutter retainers 73*d* operate in the order of FIGS. 16, 15, and 14.

Referring to FIGS. 17A to 17D, descriptions are given below of states of the shutter seal 36 relative to the toner outlet W in accordance with opening and closing movements of the shutter 34*d*.

Figure 17A:
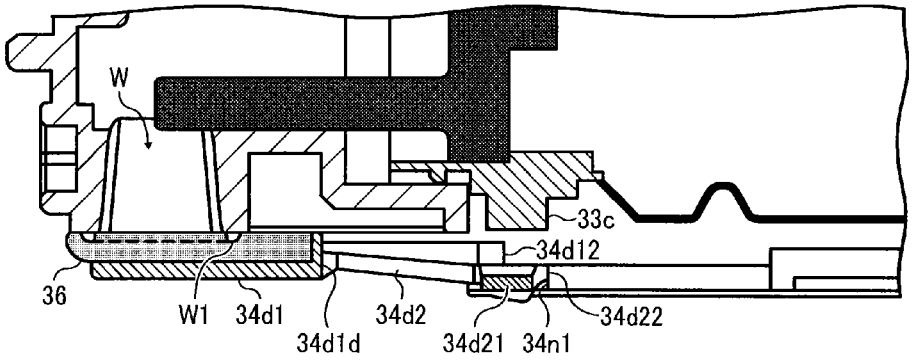
FIGS. 17A and 17B are cross-sectional views to illustrate relative positions of a toner outlet and the shutter in the cap shown in FIG. 10.

FIG. 17A illustrates a state in which the toner outlet W formed in the cap 34Y is closed by the shutter 34*d*. In this state, the developer container 32Y is not mounted in the cap holder 73, and the shutter 34*d* closes the toner outlet W. The shutter seal 36 presses against the rib W1 at the periphery of the toner outlet W. With this configuration, sealing of the toner outlet W by the shutter 34*d* is maintained.

As indicated by broken lines shown in FIG. 17A, the stopper release member 34*d*21 of the shutter 34*d* is pushed up in the direction indicated by arrow Y1 by the pressing member 72*b* of the cap holder 73.

The deformable portion 34*d*2 deforms and changes its posture from the inclined position to the horizontal position. As illustrated in FIG. 11A, the stopper 34*d*22 at the free end of the deformable portion 34*d*2 is released from the end face 34*n*1 at the wide box portion 34*n* on the bottom of the wide box portion 34*n*.

Figure 17B:
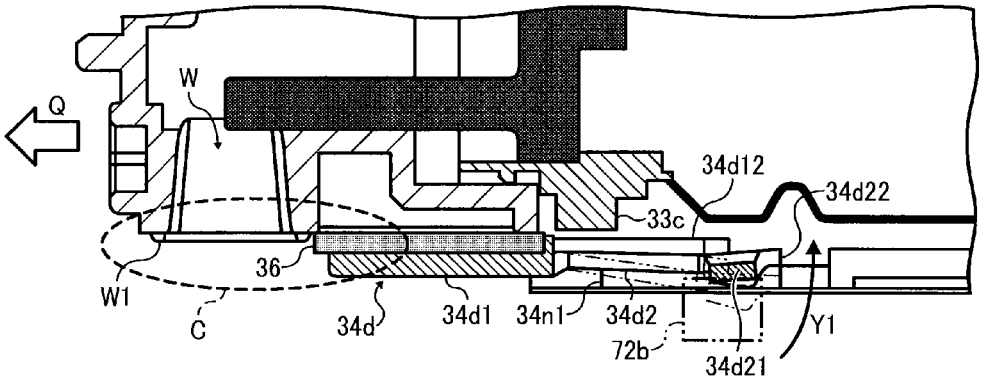

With this operation, as described with reference to FIGS. 14 through 16, the shutter 34*d* can move to the position where the projections 34*d*1*b* of the shutter 34*d* are clamped by the second arms 73*d*2 of the shutter retainers 73*d*. Then, as described with reference to FIG. 15, the shutter 34*d* is inhibited from moving in the insertion direction Q, whereas the cap 34Y can move in the insertion direction Q. Accordingly, the shutter 34*d* opens the toner outlet W as shown in FIG. 17B. FIG. 17B illustrates a state in which the developer container 32Y is inserted toward the cap holder 73.

Figure 17C:
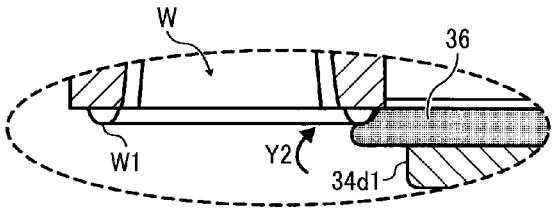
FIGS. 17C and 17D are enlarged views illustrating a seal for sealing the toner outlet.

FIG. 17C is an enlarged view of a portion enclosed by a broken circle C in FIG. 17B and illustrates a state immediately before the shutter 34*d* starts closing the toner outlet W after removal of the developer container 32Y from the apparatus body 100 is started. In this drawing, as the shutter 34*d* moves further in the closing direction, an upper corner (or ridge) on the leading side of the shutter seal 36 in the insertion direction abuts against the rib W1 at the periphery of the toner outlet W and is entangled (folded back in the direction indicated by arrow Y2) between the rib W1 and the upper face.

Figure 17D:
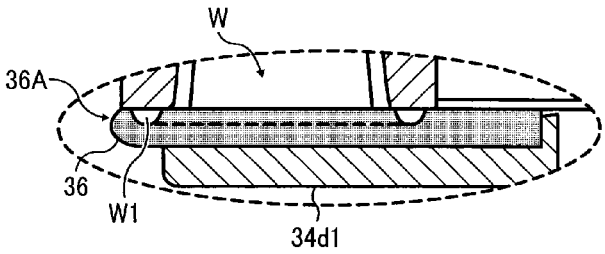

FIG. 17D illustrates a state in which the toner outlet W is fully closed by the shutter 34*d*. When closing movement of the shutter 34*d* is completed, the upper leading end (given reference character 36A) of the shutter seal 36 being folded back closely adheres to the rib W1. Then, the leading end face of the shutter seal 36 is pulled and deformed by the entangled ridge thereof. The folded portion covers the contact portion between the rib W1 and the shutter seal 36 when the cap 34Y is viewed from the front side.

With this configuration, the toner outlet W can be sealed by the shutter seal 36 until the developer container 32Y is fully mounted in the container mount 70. Accordingly, unintentional leak of toner from the toner outlet W can be inhibited.

With the above-described shutter structure, a seal member that is an existing component can be made into the shutter seal 36 having a portion that can be folded back by the contact with the rib W1. Accordingly, sealing of the toner outlet W can be enhanced without adding a special component, thus securing prevention of leak of toner.

In particular, shaping the toner outlet W into a hexagonal opening is advantageous in that the load to fold back the shutter seal 36 can be localized to the end portion thereof, and that the entire end portion can be folded back continuously with the apex of the hexagon with sliding resistance alleviated. Thus, sealing can be secured over the entire periphery of the toner outlet W.

Next, descriptions are given below of another configuration relating to the shutter retainer 73*d* and the ID chip 35 with reference to FIG. 18 and subsequent drawings.

Figure 18:
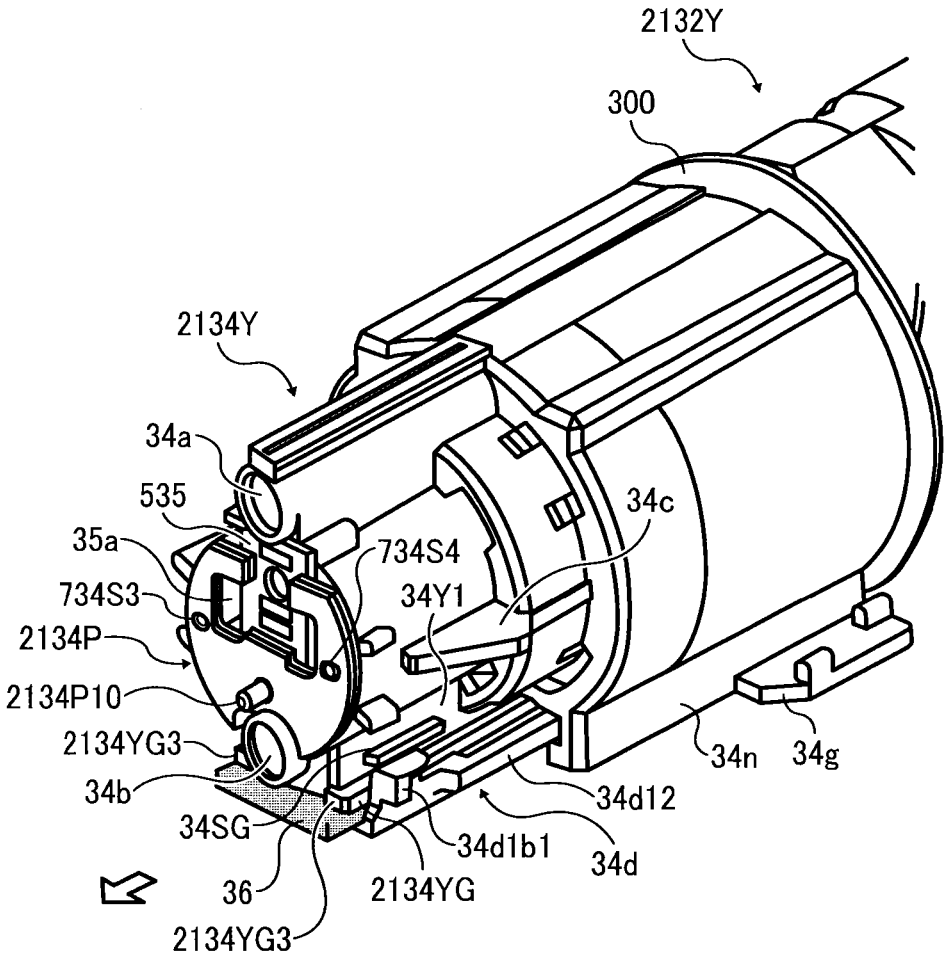
FIG. 18 is a perspective view illustrating a cap according to a variation, in which a shutter is closed.
Figure 19:
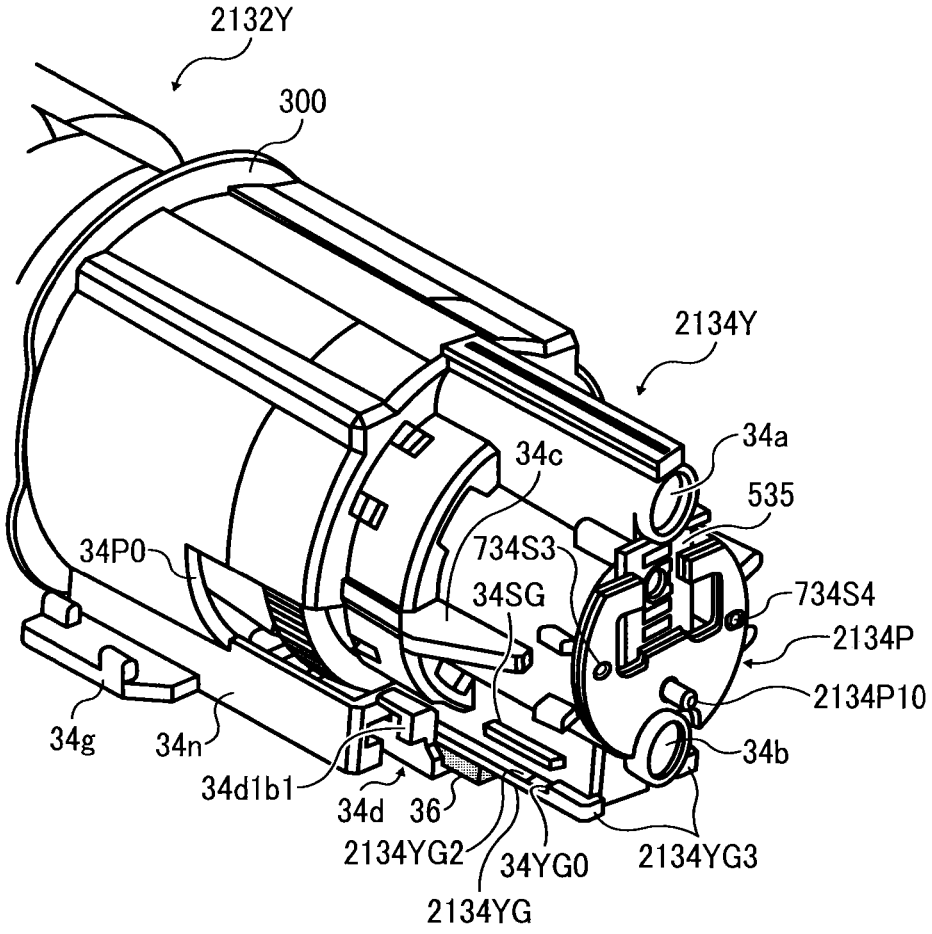
FIG. 19 is a perspective view of the cap shown in FIG. 18 as viewed from a different side.

FIG. 18 is a perspective view of a cap 2134Y of a developer container 2132Y as viewed obliquely from the downstream side in the insertion direction of the cap 2134Y indicated by a hollow arrow in FIG. 18. The shutter 34*d* is closed In FIG. 18. FIG. 19 is a perspective view of the cap 2134Y as viewed from the downstream side in the insertion direction of the cap 2134Y, from a side different from that shown in FIG. 18. The shutter 34*d* is open In FIG. 19. The configuration shown in FIGS. 18 and 19 is different from the configuration shown in FIG. 10 in that a front cover 2134P is provided on the front side of the cap 2134Y to prevent an ID chip 535 mounted in the recess 35*a* from dropping out.

As shown in FIG. 20, the front cover 2134P is attached to the cap 2134Y using a thermal caulking pin 2134P10, a main reference pin 734S3, and a sub-reference pin 734S4. The thermal caulking pin 2134P10 is positioned at a center position in the lateral direction in FIG. 20 and a lower position on the front side of the cap 2134Y. The main reference pin 734S3 and the sub-reference pin 734S4 are shifted from the thermal caulking pin 2134P10 in the vertical direction in FIG. 10 and positioned across the recess 35*a* from each other in the lateral direction.

After the front cover 2134P is fixed, the thermal caulking pin 2134P10 is heated while the end thereof is flattened by a jig. However, FIGS. 18 through 21 illustrate a state before the thermal caulking pin 2134P10 is flattened.

In the front cover 2134P, insertion holes into which the thermal caulking pin 2134P10, the main reference pin 734S3, and the sub-reference pin 734S4 are inserted; and an opening to partly expose the ID chip 535 are formed.

When the front cover 2134P engages the main reference pin 734S3 and the sub-reference pin 734S4 and fitted around the thermal caulking pin 2134P10, the front cover 2134P can be positioned to expose the ID chip 535. Then, by flattening the end of the thermal caulking pin 2134P10 while heating, the front cover 2134P is fixed to the front side of the cap 2134Y.

One of the insertion holes formed in the front cover 2134P to receive the references pins 734S3 and 734S4 can be a perfect circle and the other can be a lateral slot. The insertion hole in which the thermal caulking pin 2134P10 fits can be slightly greater in diameter than the thermal caulking pin 2134P10.

With the front cover 2134P thus fixed to the cap 2134Y, the ID chip 535 does not fall off in insertion or removal of the developer container 2132Y from the container mount 70. Further, communication and electrical connection of the ID chip 535 exposed from the mouth portion can be secured.

In addition, relating to the shutter retainer 73*d*, the configuration shown in FIGS. 18 to 21 includes the guide rails 2134YG on the respective sides of the narrow box portion 34Y1.

The guide rail 2134YG is different from the guide rail 34YG shown in FIG. 10 and other drawings. As shown in FIGS. 19 and 20, the guide rail 2134YG projects beyond the end of the narrow box portion 34Y1, and the projecting portion bent inward, forming a protruding portion 2134YG3. The protruding portion 2134YG3 is disposed symmetrically on either side of the narrow box portion 34Y1.

Figure 21:
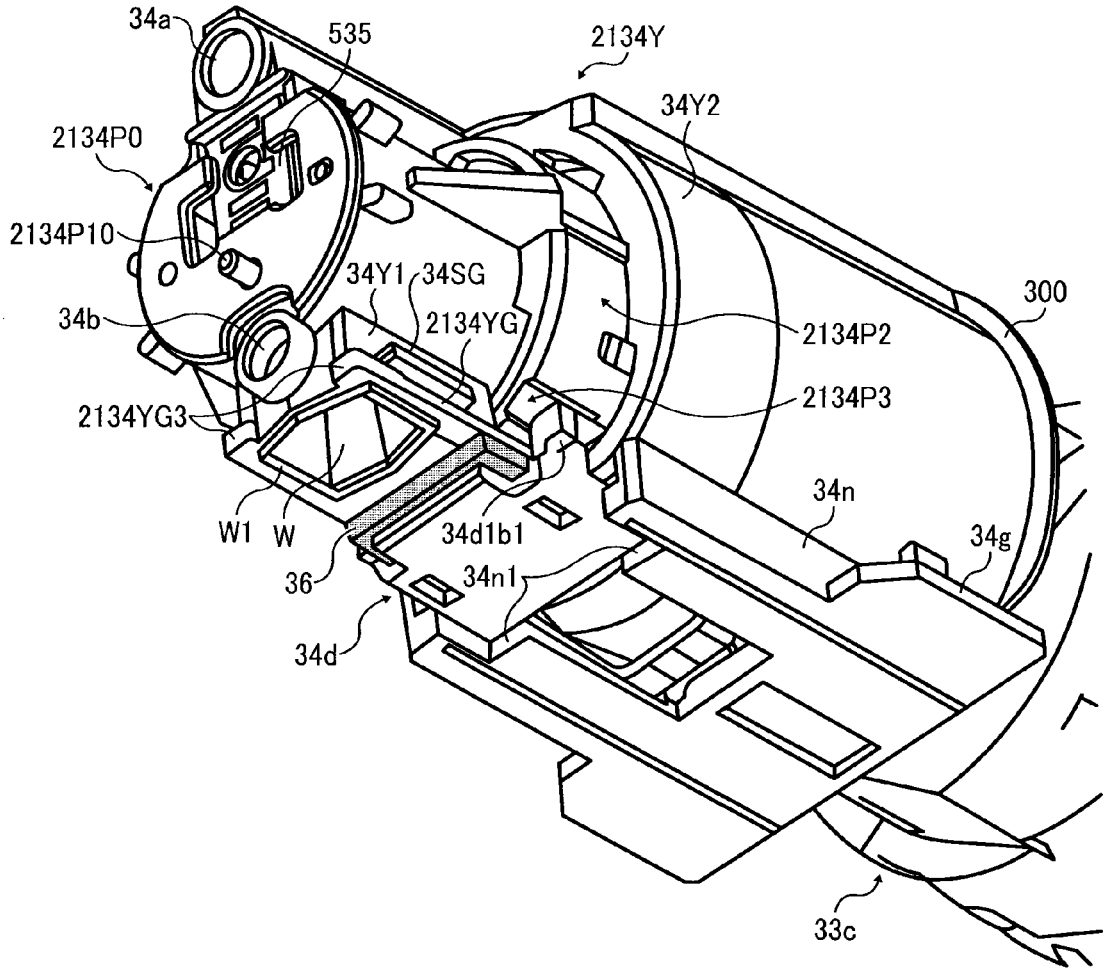
FIG. 21 is a perspective view illustrating a main part of a cap that is partly different from the cap shown in FIG. 18.

In FIG. 21, reference character 34Y2 represents the cylindrical member of the cap 2134Y, and 2134P2 represents the moderate cylindrical portion of the cylindrical member 34Y2. As shown in FIG. 21, the circumferential face of the moderate cylindrical portion 2134P2 is recessed at a position (given reference character 2134P3) to face the engaging portion 34*d*1*b* of the shutter 34*d*, thus forming a recessed face 2134P3 smaller in diameter than the moderate cylindrical portion 2134P2. The recessed face 2134P3 is configured not to interfere with the second arm 73*d*2 of the shutter retainer 73*d* shown in FIG. 14 when the second arm 73*d*2 rotates.

Figure 22:
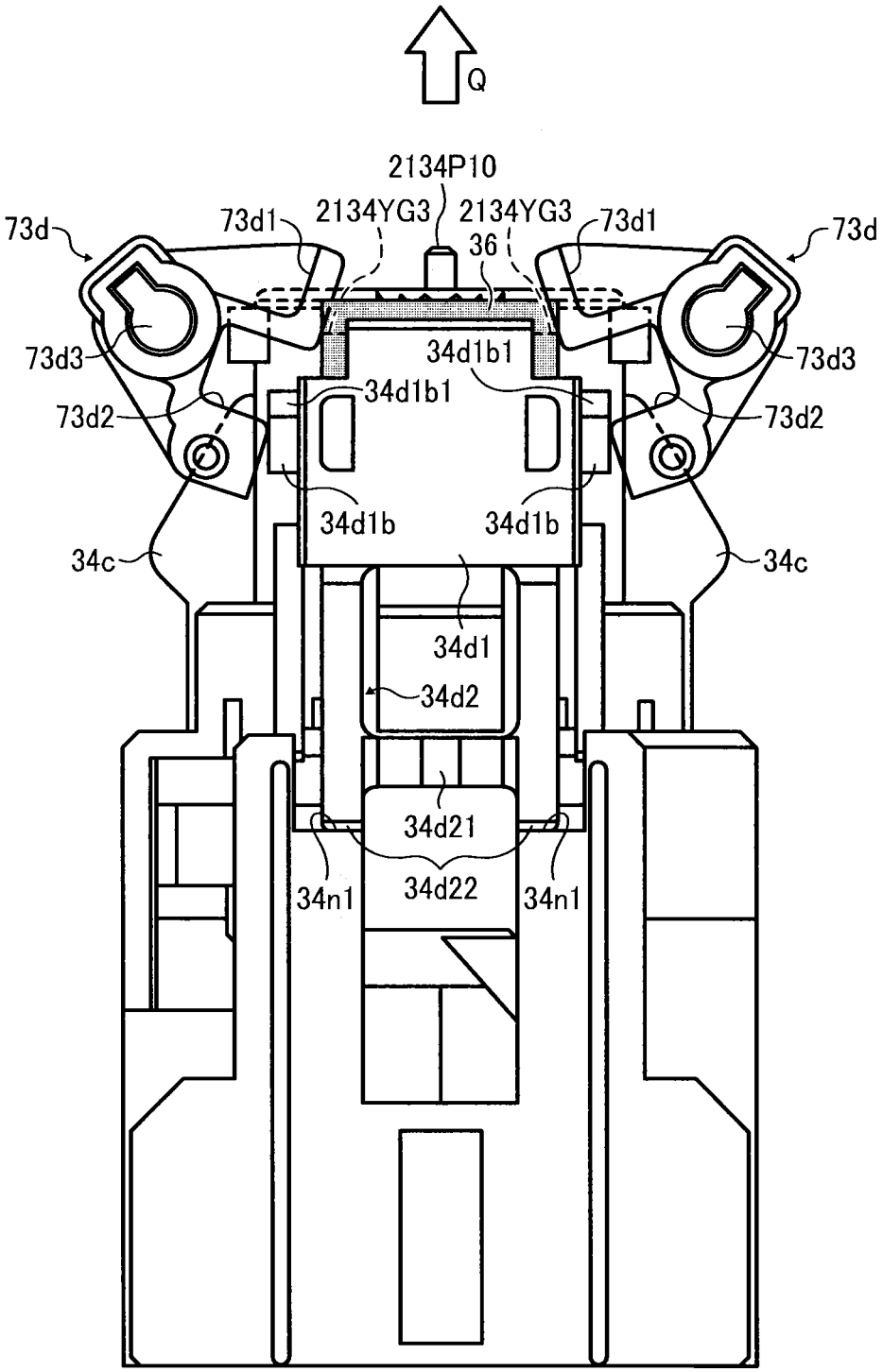
FIG. 22 is a plan view illustrating a state of the shutter retainer for the cap shown in FIG. 18.
Figure 23:
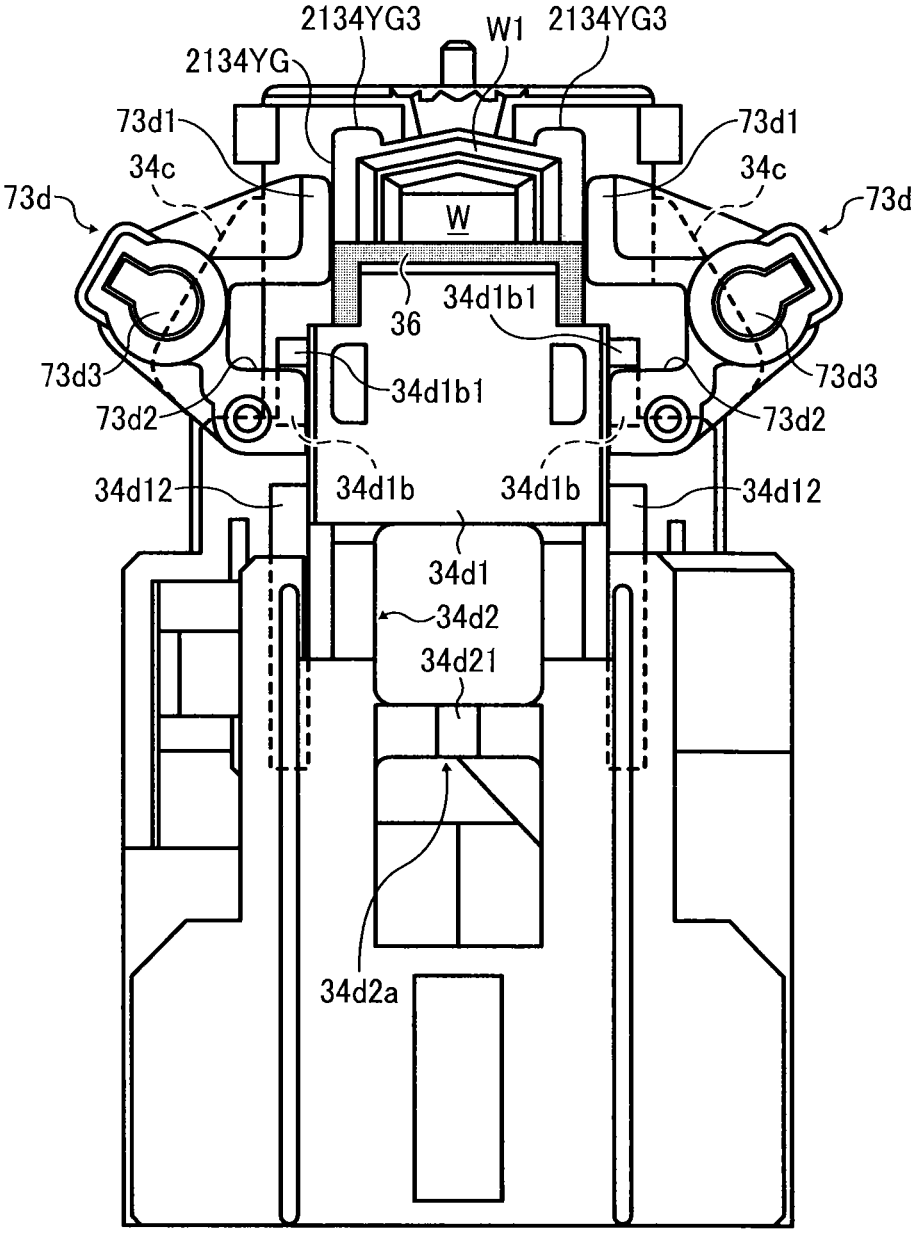
FIG. 23 is a plan view illustrating a state of the shutter retainer shown FIG. 22.
Figure 24:
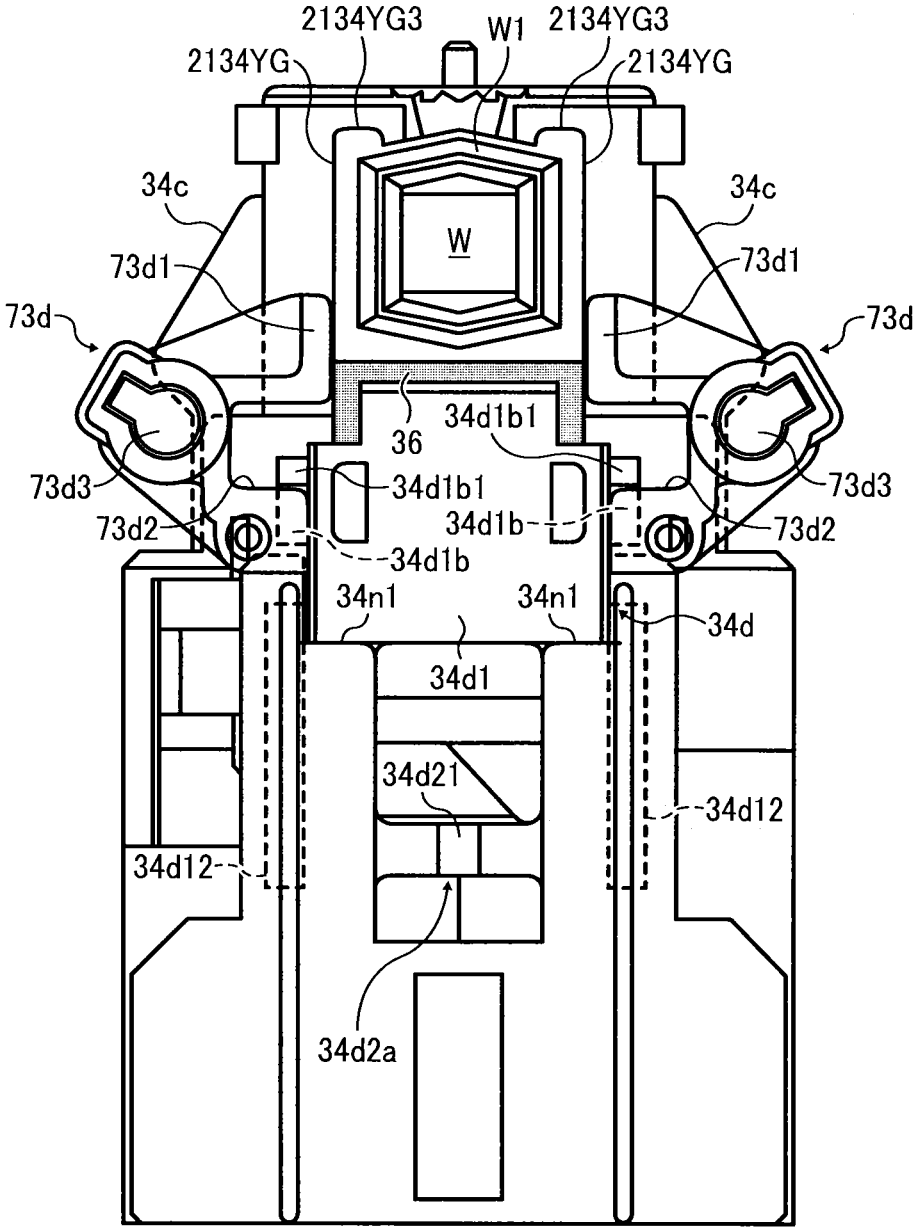
FIG. 24 is a plan view illustrating a state of the shutter retainer changed from the state shown FIG. 23.

In this configuration, similarly to the procedure shown in FIGS. 14 to 16, when the cap 2134Y is inserted into the cap holder 73 of the apparatus body 100, the shutter retainer 73*d* clamps the cap 2134Y. FIGS. 22 through 24 illustrate insertion of the cap 2134Y and correspond to FIGS. 14 through 16.

Referring to FIG. 22, when the shutter 34*d* is opened, initially, as the developer container 2132Y is inserted in the insertion direction Q shown in FIG. 22, the first arms 73*d*1 contact the protruding portions 2134YG3.

Subsequently, as the developer container 2132Y is moved further in the insertion direction Q, the shutter retainer 73*d* rotates around the support shaft 73*d*3, pushed by the protruding portion 2134YG3 as show in FIG. 23.

As the shutter retainer 73*d* rotates, as shown in FIG. 23, the first arm 73*d*1 clamps the vertical face of the guide rail 2134YG continuous with the protruding portion 2134YG3. The second arm 73*d*2 clamps the side wall of the shutter body 34*d*1 while engaging the projection 34*d*1*b*1 positioned at the engaging portion 34*d*1*b*.

Subsequently, the shutter 34*d* contacts the wall surrounding the supply inlet 73*w* (shown in FIG. 6) formed in the cap holder 73 and is prevented from moving further in the insertion direction Q. At that time, the vertical face of the guide rail 34YG is clamped by the first arm 73*d*1.

As the developer container 2132Y moves further in the insertion direction Q in this state, the shutter 34*d* moves relative to the cap 2134Y moving in the insertion direction Q, and the narrow box portion 34Y1 of the cap 2134Y reaches a position downstream from the retained shutter 34*d* in the insertion direction Q. With the relative movements, the toner outlet W is opened as shown in FIG. 24.

At that time, as shown in FIG. 24, the first arm 73*d*1 clamps the vertical face of the cap 2134Y, the second arm 73*d*2 engages the projection 34*d*1*b*1 of the engaging portion 34*d*1*b* of the shutter 34*d*. Thus, the shutter 34*d* is opened while being clamped.

Accordingly, the postures of the shutter 34*d* and the cap 2134Y in the cap holder 73 are determined, and smooth opening of the shutter 34*d* can be available.

By contrast, in removal of the developer container 2132Y from the container mount 70 (cap holder 73), the above-described processes are performed in reverse. That is, as the shutter 34*d* closes the toner outlet W, the shutter retainers 73*d* operate in the order of FIGS. 24, 23, and 22.

In the configuration shown in FIGS. 19 and 24, since the protruding portion 2134YG3 at the front end of the guide rail 2134YG projects beyond the front end of the narrow box portion 34Y1 (see FIG. 19), rotation of the shutter retainer 73*d* can be delayed. Specifically, since the protruding portions 2134YG3 project outward from the front side of the narrow box portion 34Y1, the first arms 73*d*1 can be inhibited from rotating by the protruding portions 2134YG3 for a longer time when the cap 2134Y is removed. The period during which the shutter 34*d* is clamped can be longer compared with the configuration without the protruding portions 2134YG3.

When the cap 2134Y moves in the removal direction, the first arms 73*d*1 face the projections 34*d*1*b* of the shutter 34*d* and prevented from rotating. Therefore, the amount by which the protruding portions 2134YG3 project is determined such that the shutter retainer 73*d* can be prevented from rotating until the shutter 34*d* is fully closed and the guide rails 2134YG can be released from the first arms 73*d*1 when the shutter 34*d* fully closes the toner outlet W.

The projections 34*d*1*b* of the shutter 34*d* can be clamped by the second arms 73*d*2 until the toner outlet W is fully closed by the shutter 34*d*. Accordingly, when the cap 2134Y moves in the removal direction, the shutter 34*d* traverses the toner outlet W while being clamped. Then, the toner outlet W is closed.

Figure 25:
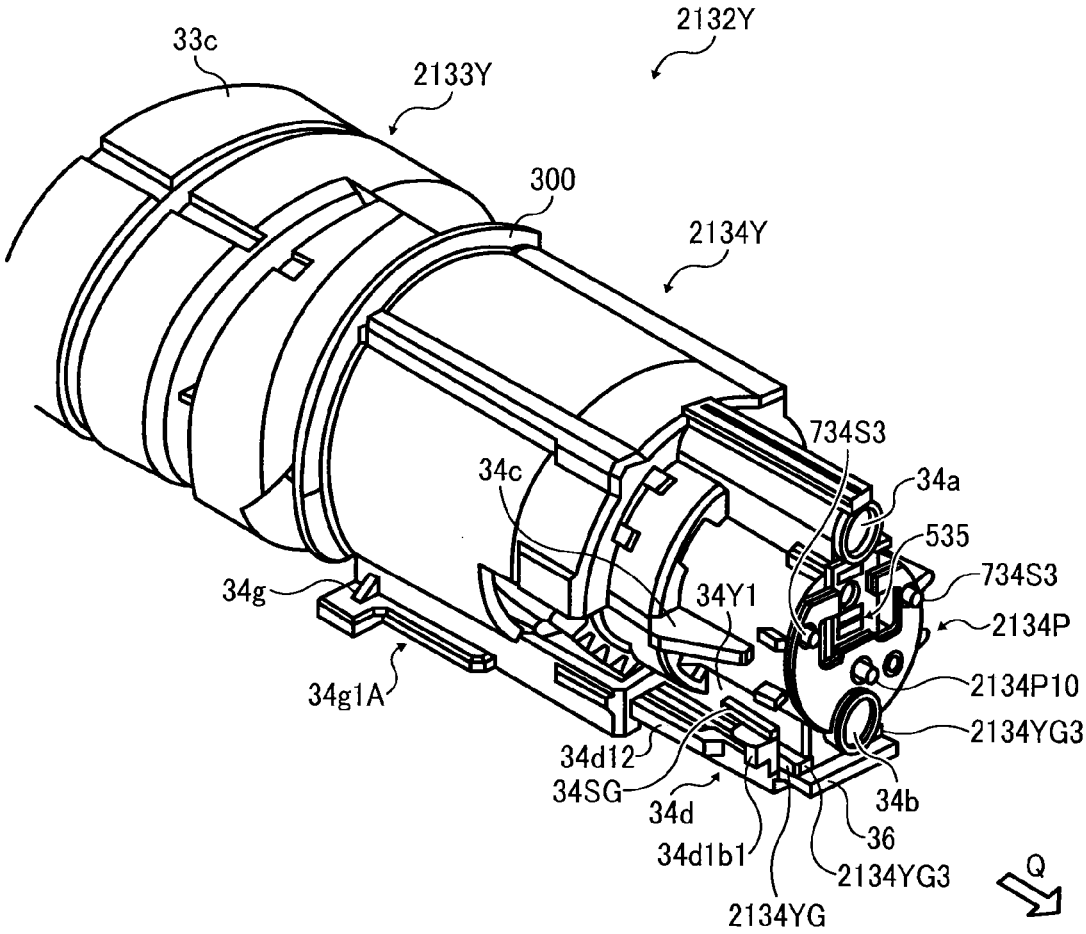
FIG. 25 is a perspective view illustrating another configuration of the cap shown in FIG. 18.

FIG. 25 is a perspective view illustrating a configuration that is partly different from the configuration shown in FIG. 18.

In the configuration shown in FIG. 25, the sliding piece 34*g*1 to which the projection 34*g* is provided is different in shape and represented by reference character 34*g*1A. The sliding piece 34*g*1A is wider on the side of the developer container 2132Y, and the portion behind it is narrower.

With this shape, in insertion into the container mount 70, sliding resistance with the guiding portion 301 can be reduced, making the insertion smooth.

Additionally, in the present embodiment, the following structure can inhibit deviation of the developer container being installed in a configuration in which the size of the insertion opening is different from the external size of the developer container.

Figure 26:
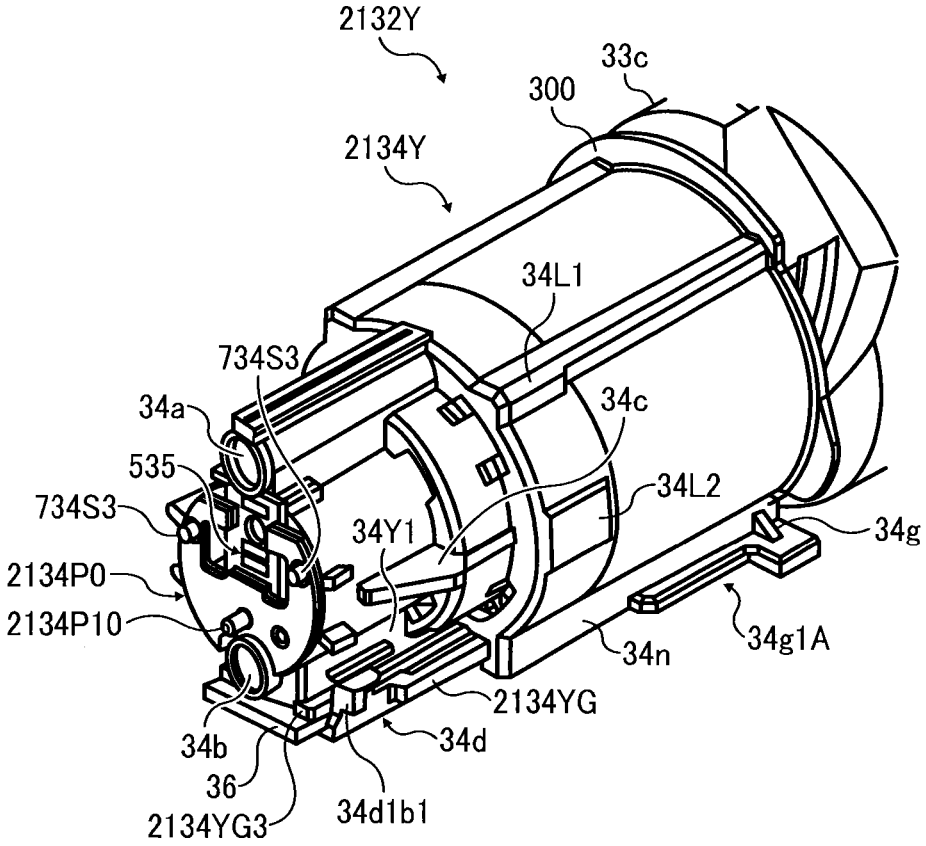
FIG. 26 is a perspective view illustrating a structure for stabilizing the posture of the developer container being installed, usable for the configuration shown in FIG. 25.

FIG. 26 is a perspective view illustrating the structure for stabilizing the posture of the developer container being installed.

In the cap 2134Y of the developer container 2132Y shown in FIG. 26, multiple projections 34L1 and 34L2 project from the outer circumferential face of the large cylindrical portion. The projections 34L1 and 34L2 are arranged in the circumferential direction. More specifically, horns-like positioning portions are formed on the right and the left in an upper portion of the large cylindrical portion of the cap 2134Y, and front portions of the horn-like projections form the projections 34L1. The projections 34L2 are positioned on the right and the left in a front portion of the cap 2134Y in the insertion direction.

This configuration can reduce the clearance between the circumference of the cap 2134Y and the inner face of the insertion portion and inhibit the developer container 2132Y from leaning to one side.

Next, descriptions are given below of toner usable for the developer replenishing device according to the above-described embodiments.

Toner usable for the above-described embodiments can have a volume average particle side Dv (μm) of 3 μm to 8 μm ($3 \leq Dv \leq 8$). Additionally, when Dn (μm) represents the number average particle size of toner, the ratio of Dv/Dn is 1.00 to 1.40 ($1.00 \leq Dv/Dn \leq 1.40$).

Accordingly, toner particles suitable to image patterns can be selected in image development, and satisfactory developing performance can be attained even when the toner is agitated in the developing device 5 for a relatively long time. Thus, high quality images can be produced. In addition, the above-described toner particles can be effectively and reliably transported without clogging toner conveyance channels (i.e., toner supply path).

It is to be noted that volume average particle diameter V and number average particle diameter Dn of the toner particles can be measured by, for example, COULTER Counter TA-II (COULTER ELECTRONIC COMPANY) or COULTER Multisizer II (COULTER ELECTRONIC COMPANY).

In addition, it is preferable that the toner used in the above-described embodiments be substantially spherical and has first and second shape factors SF-1 and SF-2 both within a range of 100 to 180. With such toner, higher transfer effectiveness can be maintained while preventing degradation of cleaning performance. In addition, the above-described toner particles can be effectively and reliably transported without clogging toner conveyance tubes forming the toner supply path.

The first shape factor SF-1 is a parameter representing the degree of roundness of toner particles and can be expressed by the following formula:

$$SF\text{-}1=(M2/S)\times(100\pi/4)$$

wherein M represents the maximum particle diameter of a toner particle projected on a two-dimensional plane, and S represents the projected area of the toner particle. The toner particle is a perfect sphere when the first shape factor SF-1 is 100. As the first shape factor SF-1 increases, the degree of sphericity decreases.

In addition, the second shape factor SF-2 represents irregularity (i.e., a degree of unevenness in the spherical surface) of toner particles and can be expressed by the following formula:

$$SF\text{-}2=(N2/S)\times(100/44\pi)$$

wherein N is the peripheral length of a toner particle projected on a two-dimensional plane and S represents the projected area of the toner particle. The surface of the toner particle is smooth when the second shape factor SF-2 is 100, and the surface of the toner particle becomes more uneven as the second shape factor SF-2 increases.

The first and second shape factors SF-1 and SF-2 can be measured by taking a photograph using a scanning electron microscope, S-800 (Hitachi, Ltd.) and analyzing the photograph using an image analyzer, LUSEX3 (NIRECO CORPORATION).

As described above, the developer container 32 according to the embodiments of the present invention is removably mountable in the apparatus body 100 of the image forming apparatus 1000 and includes the container body 33 capable of containing developer such as toner, the cap 34 in which the supply opening is formed, designed to be attached to the container body 33, and the flange 300 positioned between the container body 33 and the cap 34. The flange 300 projects in a radial direction extending from a center of a cross section of the container body (for example, perpendicular to the insertion direction). The flange 300 is formed along the circumference of the container body 33.

In the developer container 32 and the developer replenishing device 60 according to the above-described embodiments, with a simple structure, a proper posture of the developer container 32 can be maintained during insertion, and relative positions of the developer container 32 and the developer replenishing device 60 can be determined, thereby inhibiting leak of toner. In the developing device 5 and the image forming apparatus 1000 that use the above-described developer container 32 and toner replenishing device 60, above-described effects can be attained.

According to the above-described embodiments, since the flange 300 projecting in a radial direction extending from a center of a cross section of the container body 33 is provided between the container body 33 and the cap 34, the flange 300 contacts the end face enclosing the insertion opening formed in the developer replenishing device 60 when the developer container 32 leaning to one side is inserted into the insertion opening. With this configuration, it can be deemed that the position of the developer container 32 being inserted is improper. Then, the position of the developer container 32 can be corrected to adjust the relative positions between the supply opening formed in the cap 34 and the receiving inlet (supply inlet) to attain close contact therebetween. Thus, inconveniences such as toner leak caused by improper positioning of the developer container 32 can be inhibited.

Numerous additional modifications and variations are possible in light of the above teachings. It is therefore to be understood that, within the scope of the appended claims, the disclosure of this patent specification may be practiced otherwise than as specifically described herein.

It will be understood that if an element or layer is referred to as being "on," "against," "connected to" or "coupled to" another element or layer, then it can be directly on, against, connected, or coupled to the other element or layer, or intervening elements or layers may be present. In contrast, if an element is referred to as being "directly on", "directly connected to" or "directly coupled to" another element or layer, then there are no intervening elements or layers present.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer or section from another region, layer or section. Thus, a first element, component, region, layer or section discussed above could be termed a second element, component, region, layer or section without departing from the teachings of the present invention.

What is claimed is:

1. A developer container removably installable in an apparatus body of an image forming apparatus, the developer container comprising:

a container body to contain developer;

a cap connectable to the container body, the cap including a supply opening; and a flange projecting beyond an outer circumferential surface of the cap in a radial direction extending from a center of a cross section of the container body, the flange formed along a circumference of the container body and provided between the container body and the cap, wherein:

the developer container is inserted into a container mount formed on the apparatus body from an insertion opening formed in the apparatus body, and the flange projects such an amount that the flange contacts an end face surrounding the insertion opening when the developer container being inserted deviates to a side.

2. The developer container according to claim 1, further comprising sliding pieces projecting from an outer circumferential face of the cap, wherein the sliding pieces slidably engage guiding portions formed in the container mount when the developer container is inserted into the container mount, and when the developer container being inserted deviates to a side, the flange contacts the end face surrounding the insertion opening before the sliding pieces improperly engage the guiding portions.

3. A developer replenishing device comprising:

a receiving inlet to receive developer; and a developer tank to contain developer received through the receiving inlet.

wherein the developer replenishing device uses the developer container according to claim 1.

4. A developing device comprising:

a developer bearer to carry by rotation developer; and a developer containing compartment to contain developer, wherein the developing device receives developer supplied by the developer replenishing device according to claim 3.

5. An image forming apparatus comprising:

an image bearer on which a latent image is formed; and the developing device according to claim 4.

6. The developer container according to claim 1, further comprising:

toner included within the container body.

7. A developer container removably installable in an apparatus body of an image forming apparatus, the developer container comprising:

a container body to contain developer;

a cap connectable to the container body, the cap including a supply opening; and a flange projecting beyond an outer circumferential surface of the cap in a radial direction extending from a center of a cross section of the container body, the flange formed along a circumference of the container body and provided between the container body and the cap, wherein the flange is disposed at an end face of the cap on a side of the container body, and the flange extends over an entire circumference of the end face of the cap.

8. The developer container according to claim 7, further comprising:

toner included within the container body.

9. A developer container removably installable in an apparatus body of an image forming apparatus, the developer container comprising:

a container body to contain developer;

a cap connectable to the container body, the cap including a supply opening; and a flange projecting beyond an outer circumferential surface of the cap in a radial direction extending from a center of a cross section of the container body, the flange formed along a circumference of the container body and provided between the container body and the cap, wherein an outer diameter of the flange is similar to or slightly smaller than an outer diameter of the container body not to inhibit insertion of the container body.

10. The developer container according to claim 9, further comprising:

toner included within the container body.

* * * * *